US010134547B2

(12) United States Patent
Ren et al.

(10) Patent No.: US 10,134,547 B2
(45) Date of Patent: Nov. 20, 2018

(54) INSULATING HOUSING WITH INTEGRATED FUNCTIONS AND MANUFACTURING METHOD THEREFOR

(71) Applicant: Beijing Orient Vacuum Electric Co., Ltd., Beijing (CN)

(72) Inventors: Jianchang Ren, Beijing (CN); Tan Zhang, Beijing (CN)

(73) Assignee: Beijing Orient Vacuum Electric Co., Ltd., Beijing (CN)

( * ) Notice: Subject to any disclaimer, the term of this patent is extended or adjusted under 35 U.S.C. 154(b) by 0 days.

(21) Appl. No.: 15/192,088

(22) Filed: Jun. 24, 2016

(65) Prior Publication Data

US 2017/0287662 A1 Oct. 5, 2017

(30) Foreign Application Priority Data

Mar. 30, 2016 (CN) ..... 2016 1 0190752

(51) Int. Cl.
*H01H 33/662* (2006.01)
*H01H 33/12* (2006.01)

(52) U.S. Cl.
CPC ..... *H01H 33/66207* (2013.01); *H01H 33/12* (2013.01)

(58) Field of Classification Search
CPC ..... H01H 33/66207; H01H 33/66; H01H 33/6683; H01H 33/66261
USPC ..... 218/139, 118, 134, 136, 131, 155; 200/144 B; 174/50.63, 521
See application file for complete search history.

(56) References Cited

U.S. PATENT DOCUMENTS 3,178,541 A * 4/1965 Jennings ..... H01H 33/66 174/143
3,178,542 A * 4/1965 Jennings ..... H01H 33/66261 218/118
3,275,775 A * 9/1966 Hawkins ..... H01H 1/26 218/118
3,592,987 A * 7/1971 Lempert ..... H01H 33/6683 200/264
4,267,415 A * 5/1981 Holmes ..... H01H 33/66261 218/139

* cited by examiner

*Primary Examiner* — renee luebke
*Assistant Examiner* — William Bolton

(57) ABSTRACT

An insulating housing with integrated functions comprises a barrel-shaped shell, an interior wall of which being provided with a protruded or recessed uneven texture configured to increase a creepage distance between both axial ends of the barrel-shaped shell, the path of the creepage distance formed by the protruded or recessed uneven texture having more than two flyover or bypass sub-paths, such that the creepage distance is increased, and the voltage withstanding is increased.

7 Claims, 23 Drawing Sheets

INSULATING HOUSING WITH INTEGRATED FUNCTIONS AND MANUFACTURING METHOD THEREFOR

TECHNICAL FIELD

The present invention relates to the field of vacuum breakers, and particularly to an insulating housing of a vacuum interrupter in the vacuum breaker and manufacturing method therefor.

BACKGROUND

A vacuum interrupter, which is a core component of a vacuum breaker, comprises, as shown by FIG. 1, a generally barrel-shaped insulating housing 51 made of inorganic insulative materials like ceramic or glass. The insulating housing 51 is sealed on both ends thereof with metallic cover plates 52 and forms a closed container. The interior of the closed container is provided with a static contact 54 fixed on a static conductive rod 53 and a moving contact 56 fixed on a moving conductive rod 55. A corrugated pipe 57 is sealed between the moving conductive rod 55 and the metallic cover plate 52. The moving conductive rod 55 moves along its axial direction to drive the moving contact 56 to cooperate with the static contact 54 and finish opening and closing actions. A shielding cap 58 is provided surrounding the contacts and the corrugated pipe 57, in order to provide a uniform internal electric field distribution and reduce the evapotranspiration contamination of metal vapor.

During the opening of the contacts, vacuum arc is generated between the contacts. The vacuum arc is maintained by metal plasma evaporated from the contacts. When the power frequency current crosses zero, the metal vapor will stop evaporating, meanwhile the vacuum arc is extinguished since the plasma of the arc diffuses rapidly to the surroundings, and the clearance between the contacts becomes an insulator quickly; thus the current is interrupted and the metal vapor generated during arcing is condensed by the surface of the shielding cap 58. However, it is difficult for the existing vacuum interrupter to maintain a better voltage withstanding in high voltage and ultra-high voltage environment due to the limitations of its construction, so that it is hindered in the development towards high voltage and ultra-high voltage.

SUMMARY

The first object of the present invention is to provide an insulating housing with integrated functions, which has the advantage of improving its internal voltage withstanding.

The above first object of the present invention is achieved by the following technical solutions:

an insulating housing with integrated functions, comprising a barrel-shaped shell, an interior wall of the barrel-shaped shell being provided with a protruded or recessed uneven texture configured to increase the creepage distance between both axial ends of the barrel-shaped shell, the path of the creepage distance formed by the protruded or recessed uneven texture having more than two flyover or bypass sub-paths.

During the course of developing towards high voltage and ultra-high voltage, higher requirements are imposed on the voltage withstanding internal to the vacuum interrupter, which is mainly embodied in the insulation requirement for an inside of the vacuum interrupter sealed between the metallic cover plates on both axial ends of the insulating housing. By providing a protruded or recessed uneven texture on the interior wall of the barrel-shaped shell, the path of the creepage distance formed by the protruded or recessed uneven texture has more than two flyover or bypass sub-paths, thus the shortest distance between the metallic cover plates on the both open ends of the insulating housing along the interior wall of the insulating housing is increased, that is to say, the creepage distance is increased, such that the insulation internal to the vacuum interrupter formed by the insulating housing is improved, and its voltage withstanding becomes higher, providing guidance for the vacuum interrupter to develop towards high voltage and ultra-high voltage, and rendering the vacuum interrupter being suitable for the environment requirement of high voltage and ultra-high voltage.

Further, the protruded or recessed uneven texture comprises a plurality of creepage-increasing rings provided concentrically with the barrel-shaped shell, the creepage-increasing rings being in the form of circular rings protruding from the interior wall to the center of the barrel-shaped shell, neighboring creepage-increasing rings being provided along the axial clearances of the barrel-shaped shell, portions of the cross-sectional profiles of the creepage-increasing rings except for those intersecting with the barrel-shaped shell constituting the flyover sub-path.

By employing the above technical solution, the creepage distance internal to the insulating housing becomes the inner side of the longitudinal section of the barrel-shaped shell since every creepage-increasing ring is a circular ring protruding inwardly. The inner side is a combined path of the original linear path along the interior wall of the barrel-shaped shell and the flyover sub-paths, which presents overally a flyover tortuous path, greatly increasing the creepage distance, thus improving the voltage withstanding of the insulating housing.

Further, taking the cross section in which an axial midpoint of the barrel-shaped shell lies as a reference plane, each side of the creepage-increasing ring located on both sides of the reference plane facing against the reference plane is formed with a ring groove, the ring groove being recessed along the axial direction of the barrel-shaped shell towards the direction of the reference plane.

By employing the above technical solution, vacuum arc is generated by the closing and opening between the contacts in the vacuum interrupter, accompanied by melting of the metallic bridge between the contacts and evaporating of a great deal of metal vapor. The metal vapor is generated in the position between the contacts and diffuses to the surroundings, and is condensed on the interior wall of the insulating housing, resulting in a decrease in the voltage withstanding internal to the insulating housing. But the diffusion direction of the metal vapor is from the center towards the peripheral walls of the insulating housing and both ends of the insulating housing and has directivity. Therefore, although the bearing side of the creepage-increasing ring facing towards the diffusion direction of the metal vapor is still contaminated, the rear side is not contaminated by the direct evapotranspiration and is kept relatively clean, such that a plurality of annular voltage withstanding areas are formed in the interior wall of the insulating housing from one side to the other side of the sealing metallic cover plates, helping to significantly improve the voltage withstanding. Ring grooves recessed towards the center are provided in the side that is not contaminated, such that the creepage-increasing ring takes the shape of an umbrella skirt, not only further increasing the creepage distance, but also raising the proportion of area that is not contaminated by direct evapotranspiration. Thus, the voltage withstanding and after arcing insulation level of the insulating housing are improved greatly and the after arcing electric insulation level of the vacuum interrupter is not decreased and is far higher than the 75% after arcing insulation level in the industry.

Further, an inner creepage-increasing ring is provided between the neighboring creepage-increasing rings, a protruding height of the inner creepage-increasing ring being lower than that of the creepage-increasing ring along the radial direction of the barrel-shaped shell.

Due to the directivity of metal vapor evapotranspiration, by employing the above technical solution and providing an inner creepage-increasing ring whose protruding height is lower than that of the creepage-increasing ring between the neighboring creepage-increasing rings, not only the creepage distance is increased, but also the surface of the inner creepage-increasing ring is shielded by the creepage-increasing ring. Thus, the area that is not contaminated by evapotranspiration is increased by times, and the proportion of area that is not contaminated by evapotranspiration is further raised, such that the voltage withstanding and after arcing insulation level of the insulating housing are further improved.

Further, a recessed construction formed between the neighboring creepage-increasing rings constitutes a mounting site used for the getter to attach thereto.

By employing the above technical solution, a little gas is generated within the vacuum interrupter during arcing, a portion of which is absorbed by the condensed metal vapor, while the other portion is absorbed by the getter provided within the vacuum interrupter, to maintain the vacuum degree within the interrupter. In the prior art, the interior wall of the insulating housing has mostly a flat and smooth wall face, and there is not a good site for placing the getter, thus the getter is generally made into a strip shape and provided on the interior wall of the metallic cover plate or corrugated pipe, achieving mounting while avoiding influencing the voltage withstanding. But the cost of purchasing the striped getter is high and also its mounting manner is rather cumbersome. However, after providing the creepage-increasing rings, a recessed construction is formed naturally between the neighboring creepage-increasing rings. The recessed construction constitutes a good mounting site for the getter to attach thereto. A Getter of various states can be provided in the mounting site, such as slurry. The providing of a getter is integrated in the producing process of the vacuum interrupter, avoiding the added cost due to purchasing separately a commercially available striped getter, while changing the traditional thinking that the getter and the insulating housing are independent of each other, and providing guidance for modern insulating housings to be equipped with integrated functions. Also, under the masking of the creepage-increasing rings, the getter poses substantially no effect on the voltage withstanding of the vacuum interrupter, providing a high technical value.

Further, the interior wall of the barrel-shaped shell within the range of the gap of contacts is provided with an arc-leading ring used to draw arc between the contacts.

By employing the above technical solution, arcs generated during closing between the contacts are drawn and diffused on the arc-leading ring provided in the circumferential direction, thereby metal plasma is generated not only between the contacts but also between the contacts and the arc-leading ring and more metal plasma is available to maintain the arc current, which greatly improves the short-circuit current interrupting capability of the vacuum interrupter.

The second object of the present invention is to provide a vacuum interrupter having the advantage of improving its internal voltage withstanding.

The above second object of the present invention is achieved by the following technical solutions:

a vacuum interrupter, comprising the above insulating housing with integrated functions.

By employing the above technical solution, the vacuum interrupter in the prior art has been studied towards high voltage and ultra-high voltage, but has always been in the stage of exploring and there is no breakthrough. It is limited on one hand by the thinking of the existing construction of the vacuum interrupter with metallic shielding caps, on the other hand by the existing manufacturing skills, resulting that it is difficult to achieve vacuum interrupters of ultra-high voltage, such as vacuum interrupters of higher voltage withstanding level of 72 KV, 126 KV, 252 KV . . . etc. However, by employing the vacuum interrupter with the above insulating housing, the limitation of the existing thinking is broken, such that not only the vacuum interrupter can be controlled in volume, but also a variety of advantages can be integrated, such as high voltage withstanding, high after arcing insulation level, high reliability of vacuum degree and high short-circuit current interrupting capability. It provides significant promotion on the development of the vacuum interrupter and becomes a technical road necessary for the development of the vacuum interrupter.

The third object of the present invention is to provide a method for manufacturing the above insulating housing with integrated functions.

The above third object of the present invention is achieved by the following technical solutions:

a method for manufacturing the above insulating housing with integrated functions, comprising the following steps:

modeling: modeling the insulating housing with integrated functions to be manufactured to obtain a 3D model;

ingredients mixing: mixing uniformly 60-99 parts by mass of $Al_2O_3$, 3-30 parts by mass of $MnO_2$, 2-20 parts by mass of $SiO_2$, 40-150 parts by mass of powdered polyethylene wax, and 25-100 parts by mass of powdered inorganic silicate to obtain a raw material;

blank-making: importing the 3D model into a 3D printing apparatus, and making a blank according to the 3D model and employing the raw material; and sintering: sintering the blank into a finished product.

By employing the above technical solution, it has been difficult for the existing vacuum interrupter to be adapted to high voltage and ultra-high voltage. This is largely limited by the existing manufacturing methods for the insulating housing, since it is difficult to manufacture an insulating housing having a complex three-dimensional construction in the existing machining methods for the insulating housing, such as hot pressure casting, isostatic pressing, etc., due to the limitations of demolding and so on. This limits the creative ability of persons skilled in the art, rendering that persons skilled in the art do not put their efforts to improve the structural optimization of the insulating housing itself, but to other aspects, such as to improve the shielding cap. However, emergence of the 3D printing technique solves the problem commendably. Manufacturing an insulating housing having a complex three-dimensional construction by employing the 3D printing technique improves the voltage withstanding of the insulating housing significantly, pushing the vacuum interrupter to develop towards a more advanced technique.

The fourth object of the present invention is to provide another method for manufacturing the above insulating housing with integrated functions.

The above fourth object of the present invention is achieved by the following technical solutions:

a method for manufacturing the above insulating housing with integrated functions, comprising the following steps:

molds configuring: dividing the insulating housing with integrated functions to be manufactured into a number of demoldable components, and manufacturing a mold for each component or each kind of component separately;

ingredients mixing: mixing uniformly 60-99 parts by mass of $Al_2O_3$, 3-30 parts by mass of $MnO_2$, and 2-20 parts by mass of $SiO_2$ to obtain a powder material;

slurrying: adding the powder material into a melt wax and mixing and stirring it uniformly to obtain a slurry;

molding: injecting the slurry into the molds, and molding it through hot pressure casting to obtain a number of component blanks;

demolding: demolding the number of component blanks;

dewaxing and cooling: burying the number of component blanks into an absorbent, raising the temperature to 900-1100° C., and cooling the number of component blanks after dewaxing thereof;

trimming: trimming the number of component blanks to obtain a desired shape;

assembling: adhering the number of component blanks into a complete insulating housing blank to be manufactured; and sintering: putting the insulating housing blank into a sintering furnace and sintering it into a finished product.

By employing the above technical solution, with a thinking style of calculus, an insulating housing having a complex three-dimensional construction is divided into a number of demoldable components, and each component blank is adhered and assembled into a complete insulating housing blank after being molded separately through hot pressure casting, and is sintered to obtain a finished product. The above operations overcome the technical challenge that an insulating housing of a complex construction cannot be manufactured through hot pressure casting as generally thought in the prior art, widening the thinking in the field of insulating housing manufacturing, while providing significant help for the vacuum interrupter to develop towards advanced high voltage and ultra-high voltage.

The fifth object of the present invention is to provide another method for manufacturing the above insulating housing with integrated functions.

The above fifth object of the present invention is achieved by the following technical solutions:

a method for manufacturing the above insulating housing with integrated functions, comprising the following steps:

molds configuring: dividing the insulating housing with integrated functions to be manufactured into a number of demoldable components, and manufacturing a mold for each component or each kind of component separately;

ingredients mixing: mixing uniformly 60-99 parts by mass of $Al_2O_3$, 3-30 parts by mass of $MnO_2$, 2-20 parts by mass of $SiO_2$ and 9-15 parts by mass of adhesive to obtain a powder material;

ingredients filling: pouring the powder material into the individual molds, and drawing air out;

isostatic pressing: placing each mold filled with the ingredients within a pressurized container, and molding it with a hot or cold or warm isostatic pressing technique to obtain various component blanks;

demolding: demolding the number of component blanks;

trimming: trimming the number of component blanks to obtain a desired shape;

assembling: adhering the number of component blanks into a complete insulating housing blank to be manufactured; and sintering: putting the insulating housing blank into a sintering furnace and sintering it into a finished product.

By employing the above technical solution, in the field of producing and manufacturing an insulating housing through an isostatic pressing technique, there is also a limitation that only the insulating housing of a simple three-dimensional construction can be machined by a common mold, while an insulating housing of a complex three-dimensional construction is difficult to machine. With a thinking style of calculus, an insulating housing having a complex three-dimensional construction is divided into a number of demoldable components, and each component blank is adhered and assembled into a complete insulating housing blank after being molded separately through an isostatic pressing technique, and is sintered to obtain a finished product. The above operations overcome the technical challenge that an insulating housing of complex construction cannot be manufactured through isostatic pressing as generally thought in the prior art, widening the thinking in the field of insulating housing manufacturing, while providing significant help for the vacuum interrupter to develop towards advanced high voltage and ultra-high voltage.

Above all, the present invention yields the following beneficial effects:

With the added uneven texture internal to the barrel-shaped shell, the creepage distance is increased, and the voltage withstanding is increased. Also, by employing the construction of creepage-increasing rings, not only the creepage distance is increased greatly, but also the barrel-shaped shell is avoided from full-interior wall contamination by metal vapor evapotranspiration, thus under the double effects of a greater creepage distance and a greater proportion of uncontaminated area, the voltage withstanding and after arcing insulation level of the insulating housing are improved greatly, and the after arcing electric insulation level of the vacuum interrupter is not decreased. With providing an arc-leading ring, more metal plasma is provided in order to maintain arc, and the short-circuit interrupting capability is enhanced. Moreover, by changing the old way of mounting the getter, the mounting of the getter can be integrated in the producing process of the vacuum interrupter, thus raising the reliability level of vacuum degree.

Therefore, the insulating housing is equipped with the following integrated functions: first, the effect of the getter; second, the effect of the middle shielding cap; and third, the powerful effect of shielding the evapotranspiration of metal vapor, etc. Thus, the insulating housing of the present invention has the following advantages: high reliability of vacuum degree, non-decreasing after arcing voltage withstanding level, high short-circuit interrupting capability, and very high internal voltage withstanding performance, etc., and becomes a technical route necessary to be used in vacuum interrupter products in the field of ultra-high voltage and with non-decreasing after arcing insulation level.

In the figures, 1, barrel-shaped shell; 2, arc-leading ring; 21, mounting ring; 211, engaging groove; 22, spherical contact; 23, pillar contact; 24, annular contact; 3, creepage-increasing ring; 30, mounting site; 31, ring groove; 32, inner creepage-increasing ring; 33, embedding groove; 34, ring undercut; 35, ring sheet; 36, clearance sheet; 41, spiral relief; 42, first labyrinth relief; 43, second labyrinth relief; 51, insulating housing; 52, metallic cover plate; 53, static conductive rod; 54, static contact; 55, moving conductive rod; 56, moving contact; 57, corrugated pipe; 58, shielding cap; a, clean band; b, contaminated band; c, mounting band; d, linear path; e, flyover sub-path; f, bypass sub-path; 0E, insulating housing blank; 1E, barrel-shaped shell blank; 3E, creepage-increasing ring blank; 21E, mounting ring blank.

DETAILED DESCRIPTION

The present invention is further illustrated in details below in connection with the accompanying drawings.

Embodiment 1

Figure 1:
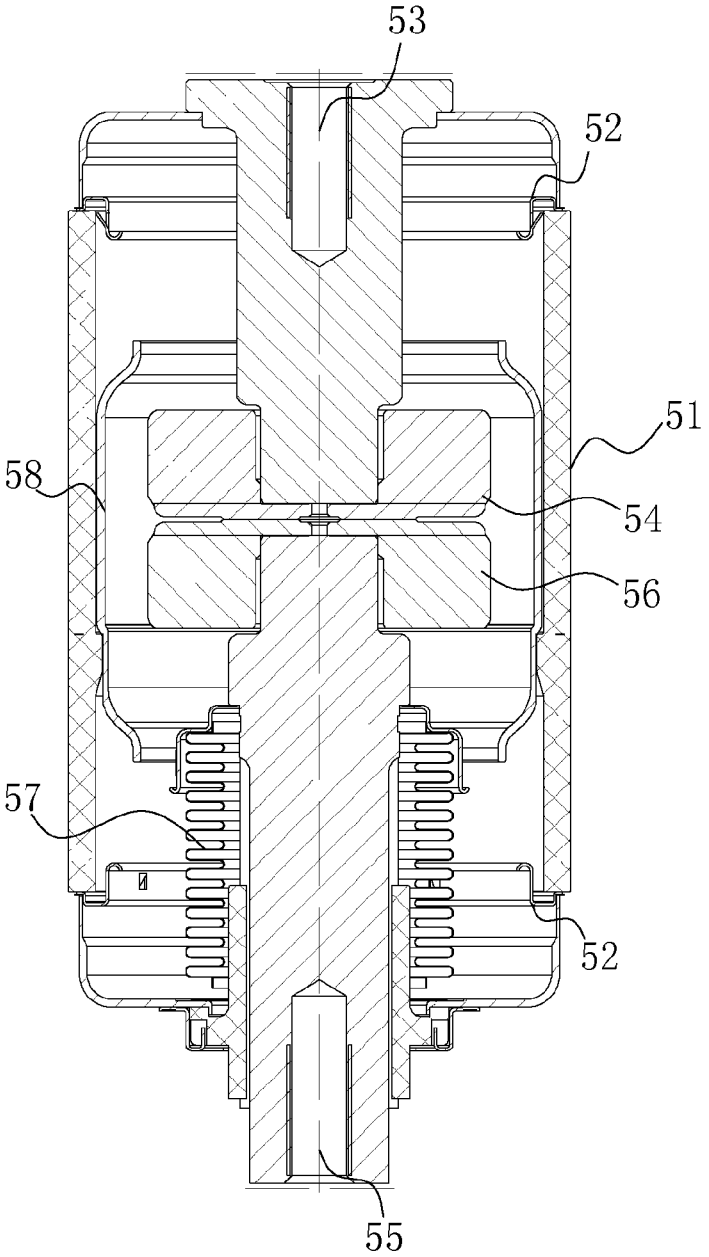
Fig.1 (Prior Art)
FIG. 1 is a cutaway view of a vacuum interrupter in the prior art.
Figure 2:
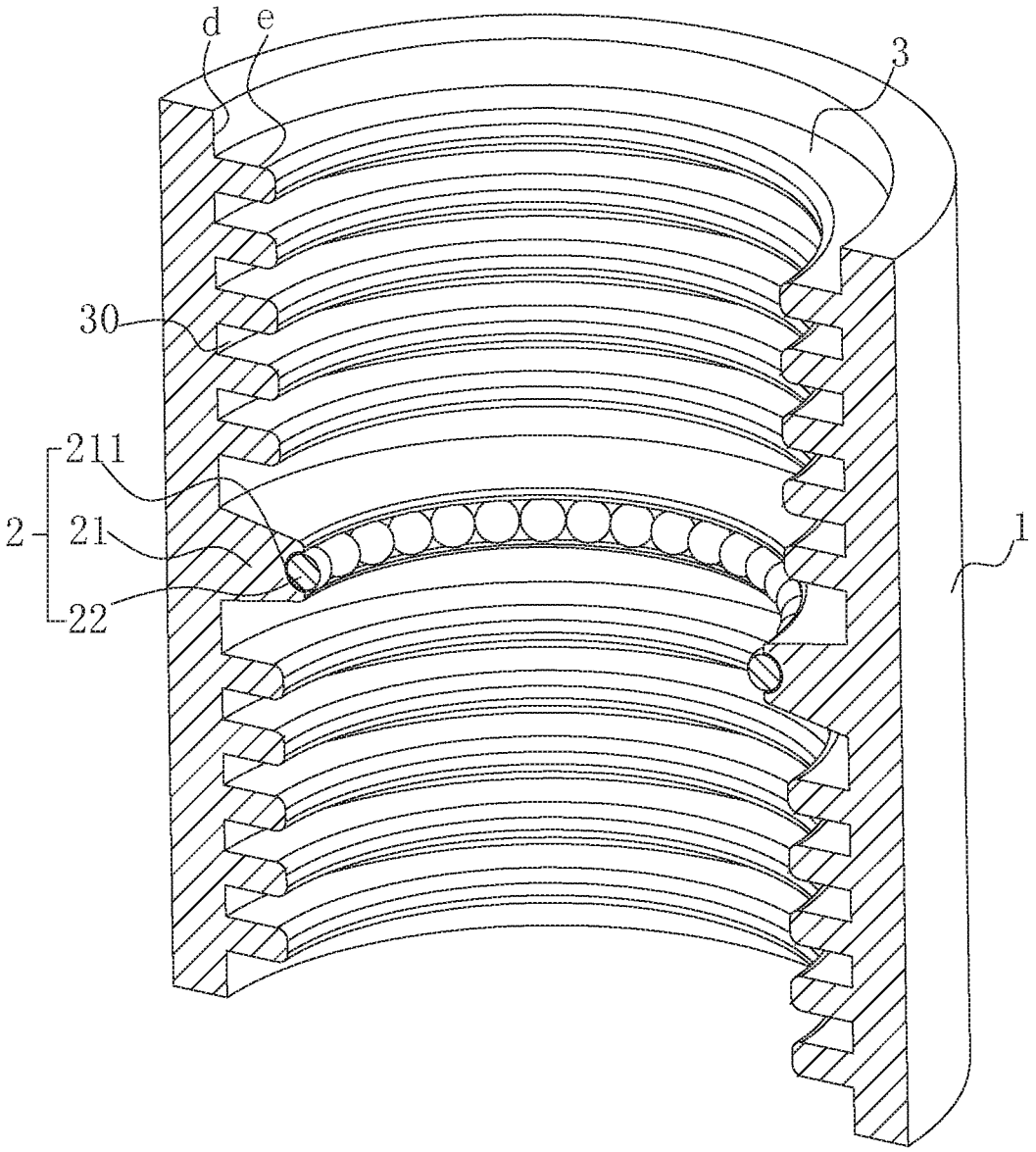
FIG. 2 is a half-cutaway schematic perspective view of the internal structure of embodiment 1.
Figure 3:
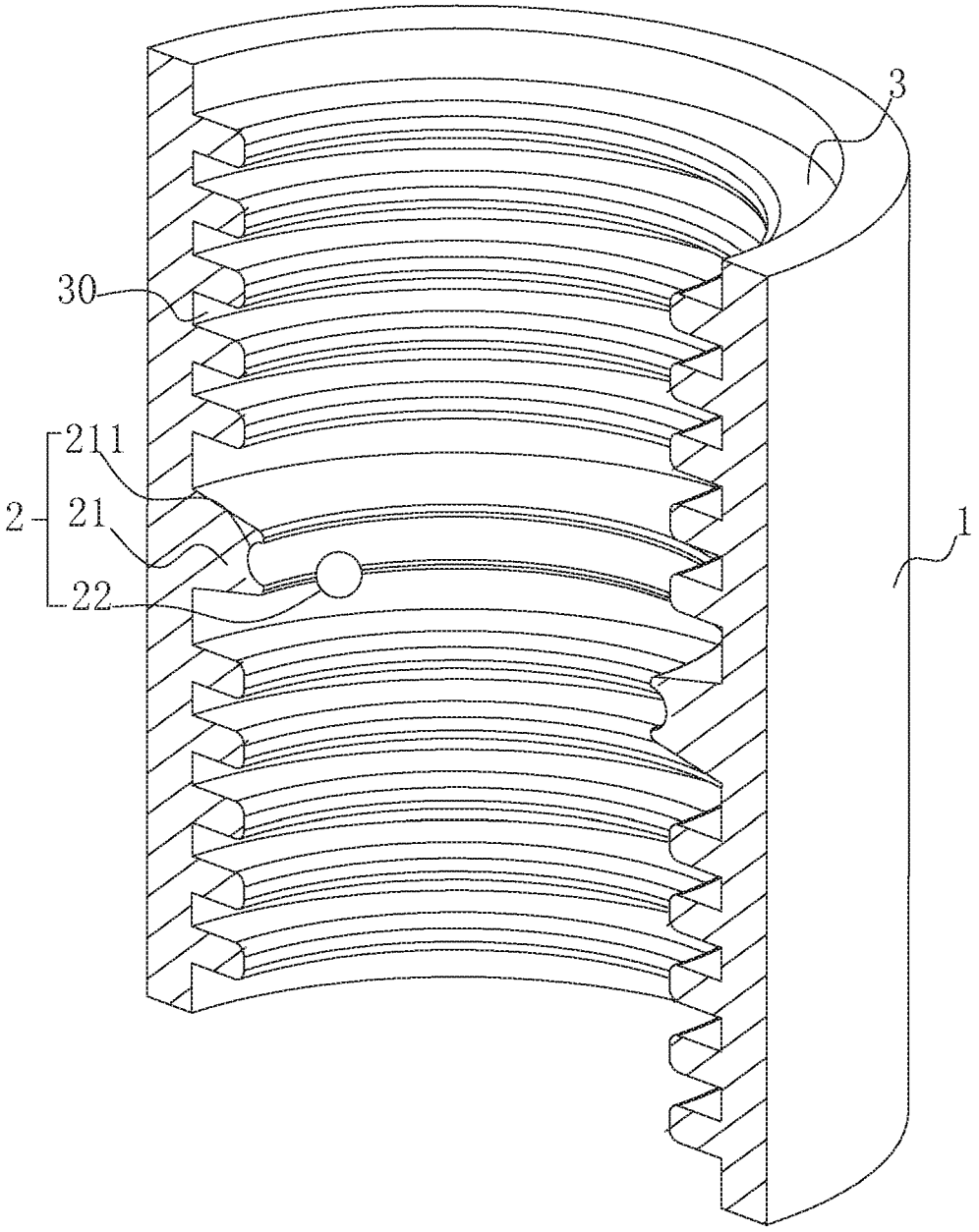
FIG. 3 is a schematic view of the structure of spherical contacts and mounting rings of embodiment 1.

Referring to FIGS. 2 and 3, an insulating housing with integrated functions comprises a barrel-shaped shell 1. Here, the term "barrel-shaped" is intended to comprise but not limited to a cylinder, sphere, ellipsoid, spindle or any other stereo shape, and embodiment 1 is illustrated by the cylindrical barrel-shaped shell 1. The barrel-shaped shell 1 can be made of glass, ceramic, glass-ceramic or plastic, and embodiment 1 is illustrated by a ceramic material. Openings on both ends of the barrel-shaped shell 1 are sealed with metallic cover plates to constitute a sealed vacuum interrupter. As can be seen in FIG. 2, an arc-leading ring 2 is located in the axial middle position of the barrel-shaped shell 1. The arc-leading ring 2 comprises an annular mounting ring 21, an inner circumference of which is formed with an annular engaging groove 211. The engaging groove 211 is configured to engage and connect spherical contacts 22, which are uniformly distributed in the engaging groove 211. The spherical contacts 22 are made of copper-chromium alloy (CuCr). The spherical contacts 22 are connected with the engaging groove 211 by employing a ceramic-to-metal soldering technique in which the internal ceramic on the interior wall of the engaging groove 211 is metallized and the spherical contacts 22 are soldered with the engaging groove 211 using nickel as a solder, as shown by FIG. 2.

In high voltage and ultra-high voltage power transmission and distribution lines, current needs to be reduced to very low in order to reduce loss, thereby a phenomenon of cutoff over-voltage can be easily caused when the vacuum breaker interrupts the low current. This is mainly because that the arc current at which the interruption occurred is low and the metal vapor (metal plasma) provided by cathode spots of the contacts is not adequate and stable enough to maintain the arc current, causing cutoff by a forced arc extinguishing when the current reaches a certain instantaneous value before zero-crossing, which causes damages to the insulation of lines and electronic apparatus.

The arc-leading ring 2 is located at the axial middle position of the barrel-shaped shell 1, which is within the range of a gap of the contacts. When arc is generated between the contacts, the arc-leading ring 2 draws the arc distributed on the surfaces of the contacts to itself, thereby metal plasma is generated not only between the contacts but also between the contacts and the arc-leading ring 2 and more metal plasma is available to maintain the arc current, such that the arc current is not extinguished until reaching a small value approaching the zero-crossing, which greatly improves the short-circuit interrupting capability of the vacuum interrupter.

The arc-leading ring 2 is provided with five concentric creepage-increasing rings 3 along either axial side thereof. The creepage-increasing rings 3 are separated by a certain clearance, such that the shortest path between both ends of the barrel-shaped shell 1 along the interior wall presents overally a flyover tortuous path (as demonstrated by the inner side of the cutaway section in FIGS. 2 and 3) including linear paths d along the interior wall of the barrel-shaped shell 1 and parallel to the axis as well as flyover sub-paths e which fly over the creepage-increasing rings 3. The starting and ending points of the flyover sub-paths e are critical points at which departure from and arrival at the interior wall of the barrel-shaped shell 1 are done, respectively. The plurality of flyover sub-paths e increase the creepage distance between both ends of the barrel-shaped shell 1 along the interior wall, at the same time, when metal vapor evapotranspires, one side of each creepage-increasing ring 3 facing against the arc-leading ring 2 constitutes a clean band a (see FIG. 4) that is not contaminated by the direct evapotranspiration of metal vapor. Since the creepage-increasing ring 3 is circular, the clean band a is also circular. The clean bands a, contaminated bands b and mounting bands c (i.e., the interior wall side of the engaging groove 211) for mounting the spherical contacts are shown in FIG.

Figure 4:
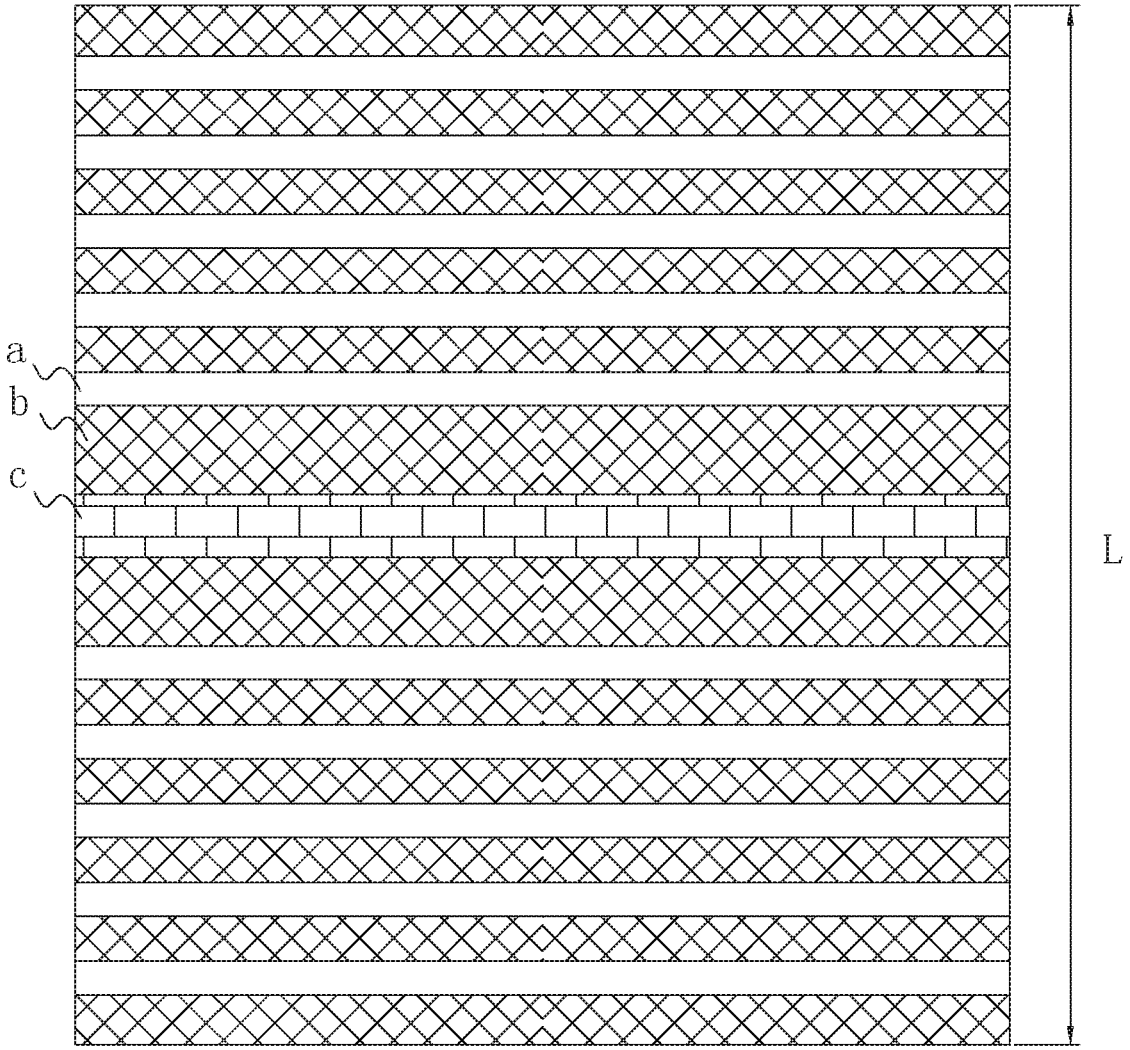
FIG. 4 is a deployed schematic view of the interior wall after arcing of the insulating housing of embodiment 1.

4 when the interior wall after arcing of the insulating housing is deployed. The contamination degree of the interior wall of the insulating housing is one of the key factors that determine the internal voltage withstanding and after arcing insulation level of the vacuum interrupter. The clean bands a are not contaminated by the direct evapotranspiration of metal vapor, such that the interior wall of the barrel-shaped shell 1 is avoided from a full-wall face contamination. The contaminated bands b are partitioned in intervals with a plurality of annular voltage withstanding areas (i.e., the clean bands a), such that the voltage withstanding and after arcing insulation of the insulating housing are improved significantly. Also, FIG. 4 shows a length L which represents the creepage distance of the interior wall of the barrel-shaped shell 1. The plurality of creepage-increasing rings 3, which are provided in intervals, form a plurality of flyover sub-paths e, which increases the creepage distance per unit axial length, while functioning to increase the creepage distance and to shield the interior wall of the barrel-shaped shell 1 from being contaminated by metal vapor, such that the insulating housing is suitable for the high voltage and ultra-high voltage application environment.

Referring again to FIGS. 2 and 3, a recessed construction is formed naturally between neighboring creepage-increasing rings 3. The recessed construction constitutes a good mounting site 30 for a getter to attach thereto. A getter of various states can be provided in the mounting site 30, for example, a slurry getter is coated thereon, which is made by mixing zirconium-aluminum alloy 16 (ZrAl (16)), titanium powder (Ti), zirconium powder (Zr), tantalum powder (Ta) and niobium powder (Nb), etc., for instance, with banana oil and nitrocellulose. By employing a once seal-exhaust (one shot brazing) technique, the providing of getter is integrated in the process of producing the vacuum interrupter, avoiding the added cost due to purchasing separately a commercially available striped getter, while changing the traditional thinking that the getter and the insulating housing are independent of each other, and providing guidance for modern insulating housings to be equipped with integrated functions. Also, under the masking of the creepage-increasing rings 3, the getter poses substantially no effect on the voltage withstanding of the vacuum interrupter, providing a high technical value.

Embodiment 2

Figure 5:
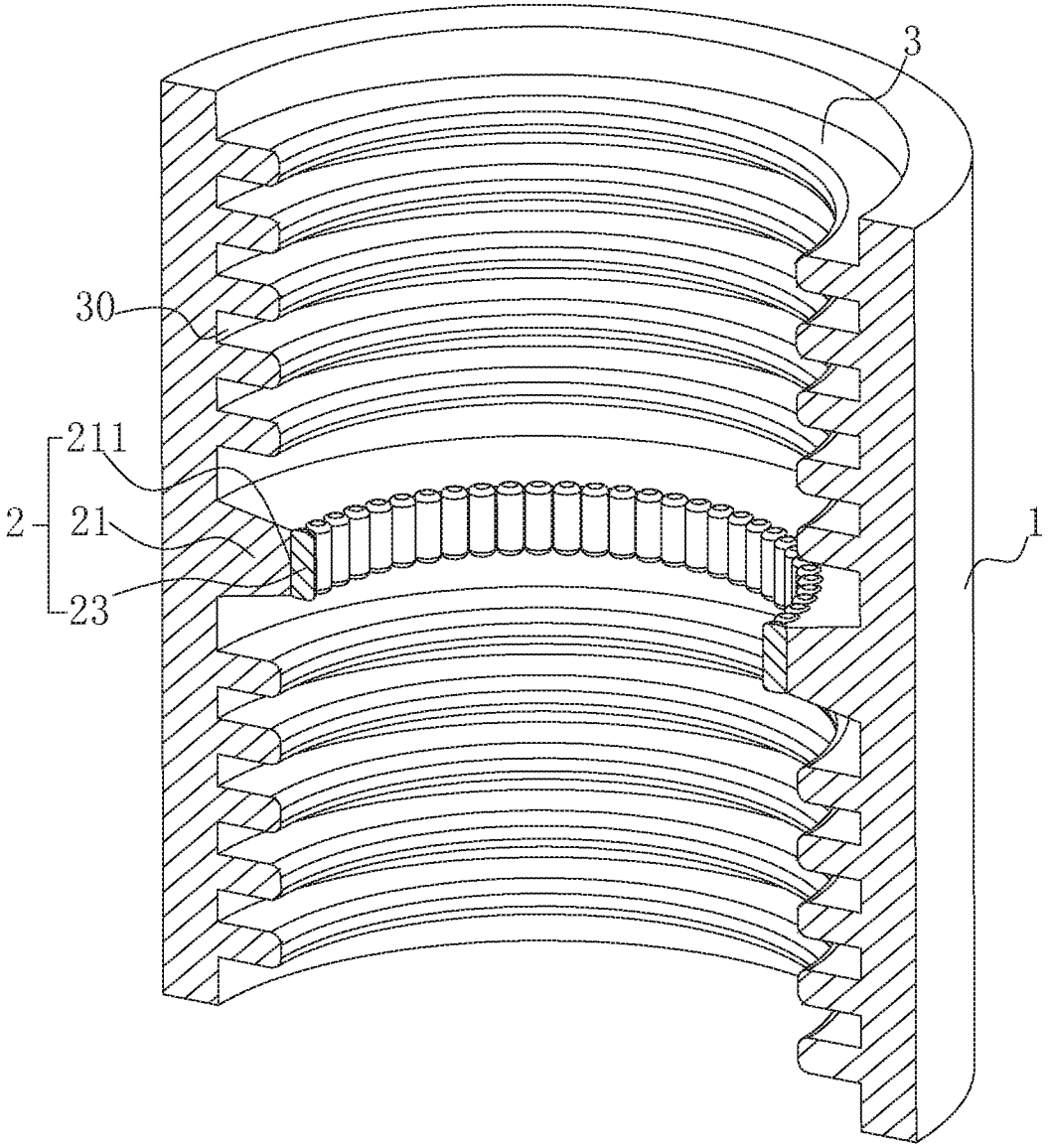
FIG. 5 is a half-cutaway schematic perspective view of the internal structure of embodiment 2.

Referring to FIG. 5, an insulating housing with integrated functions differs from embodiment 1 in that pillar contacts 23 are substituted for the spherical contacts 22. With respect to the choice of the shape of contacts on the arc-leading ring 2 used to draw arc between the contacts, shapes with sharp burrs or corners should be avoided from use as far as possible in order to reduce the influences on the magnetic field within the vacuum interrupter by the contacts and improve the voltage withstanding of the vacuum interrupter. The pillar contacts 23 demonstrated in the figure have a greater length in the axial direction of the barrel-shaped shell 1, and thus are suitable for vacuum breakers of higher voltage with a larger gap between the contacts.

Embodiment 3

Figure 6:
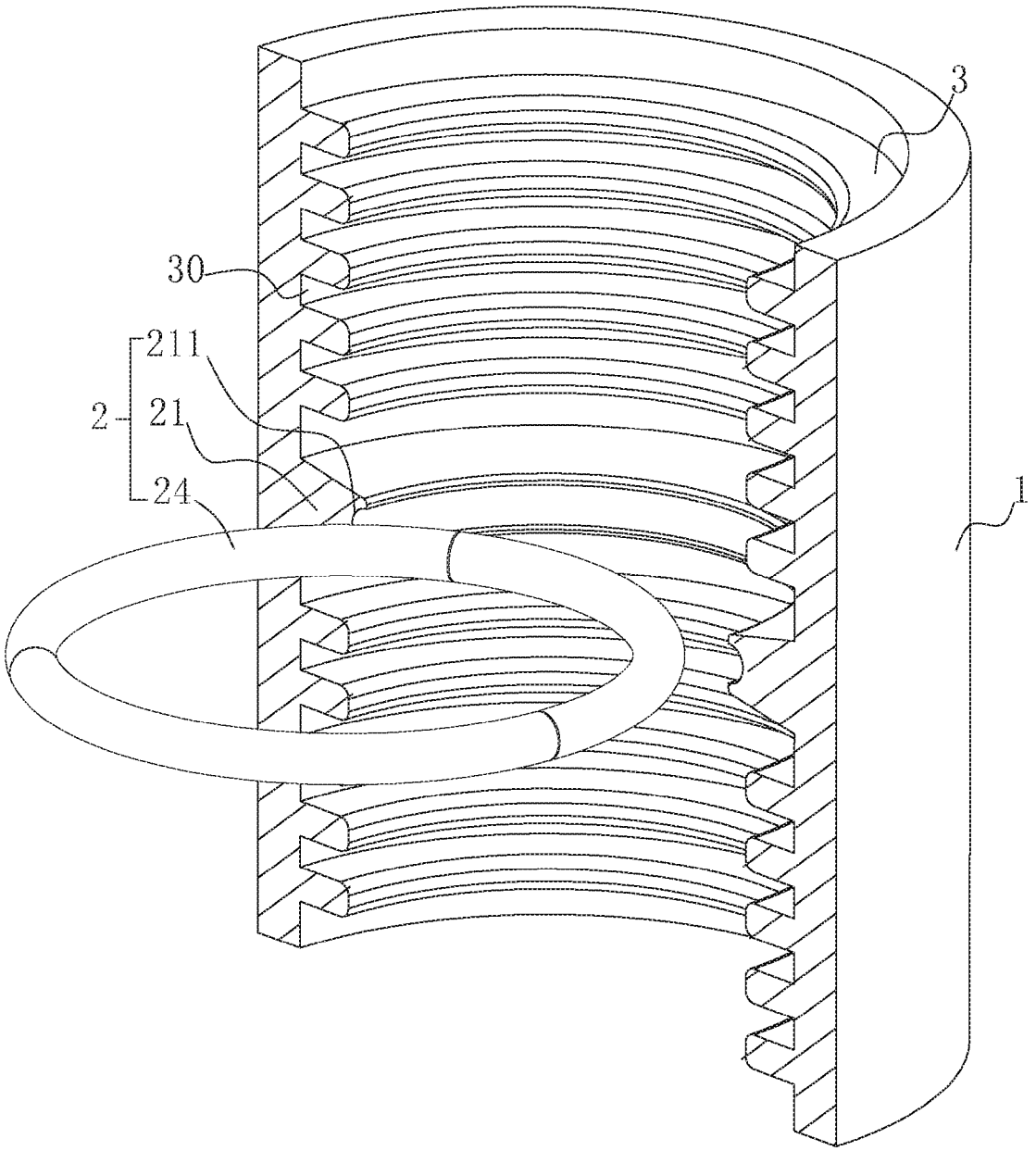
FIG. 6 is a half-cutaway schematic perspective of the internal structure of embodiment 3.

Referring to FIG. 6, an insulating housing with integrated functions differs from embodiment 2 in that an annular contact 24 is substituted for the pillar contacts 23. Since the outer diameter of the annular contact 24 matches with the diameter of the engaging groove 211, it is difficult to mount a whole circular ring into the engaging groove 211, therefore the annular contact 24 is divided into three or more equal-length circular arcs which are mounted and soldered within the engaging groove 211 one by one and then form the whole circular ring.

Embodiment 4

Figure 7:
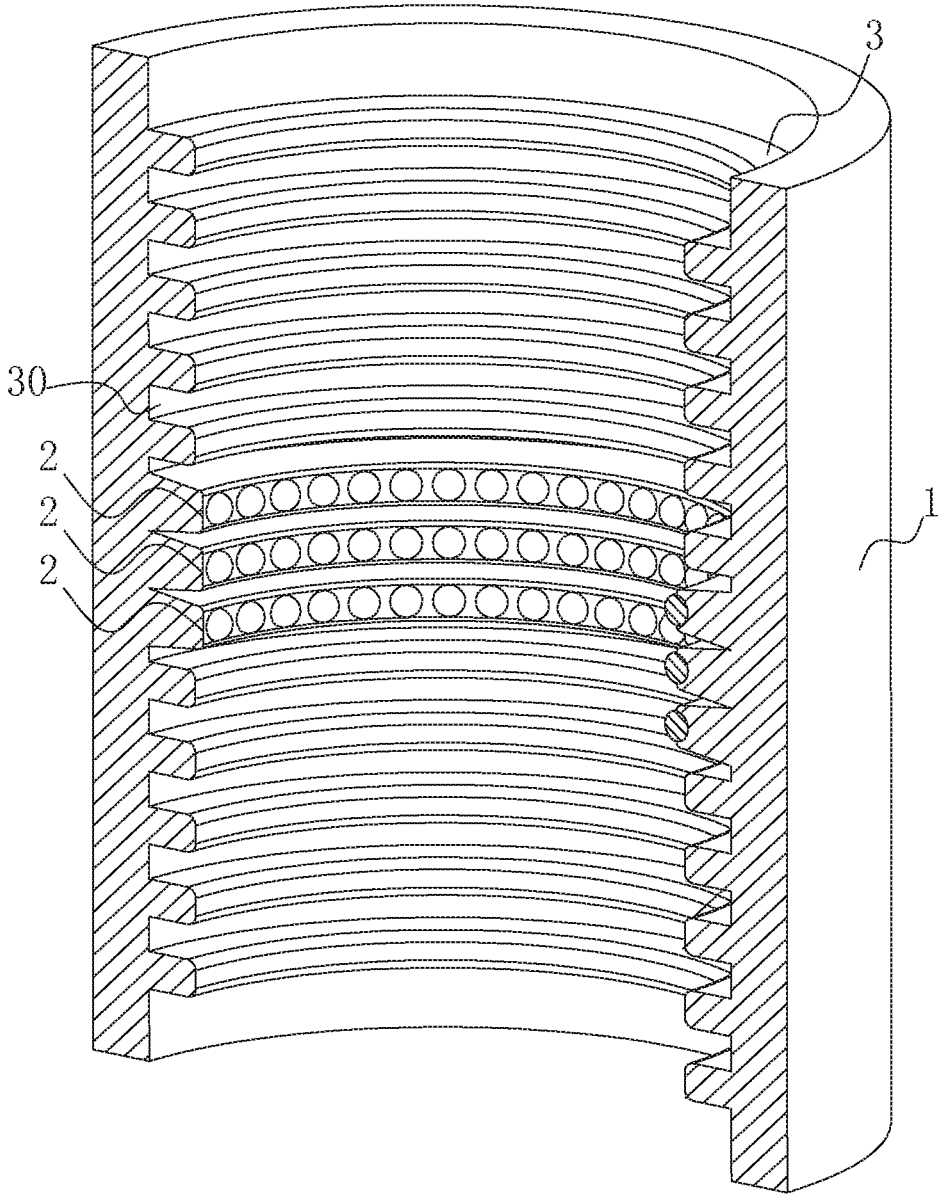
FIG. 7 is a half-cutaway schematic perspective view of the internal structure of embodiment 4.

Referring to FIG. 7, an insulating housing with integrated functions differs from embodiment 1 in that a middle section of the barrel-shaped shell 1 is provided concentrically with three layers of arc-leading rings 2. While vacuum interrupters are developed towards high voltage and ultra-high voltage, the gap between contacts is increased grade by grade as the voltage grade rises. The arc-leading ring 2 functions to draw arc between the contacts to generate more metal plasma, therefore as many arc-leading rings 2 as possible are arranged in the range of the gap of the contacts to generate adequate metal plasma. The barrel-shaped shell 1 provided with three and more layers of arc-leading rings 2 is suitable for vacuum interrupters of ultra-high voltage grade with a larger gap between contacts.

Embodiment 5

Figure 8:
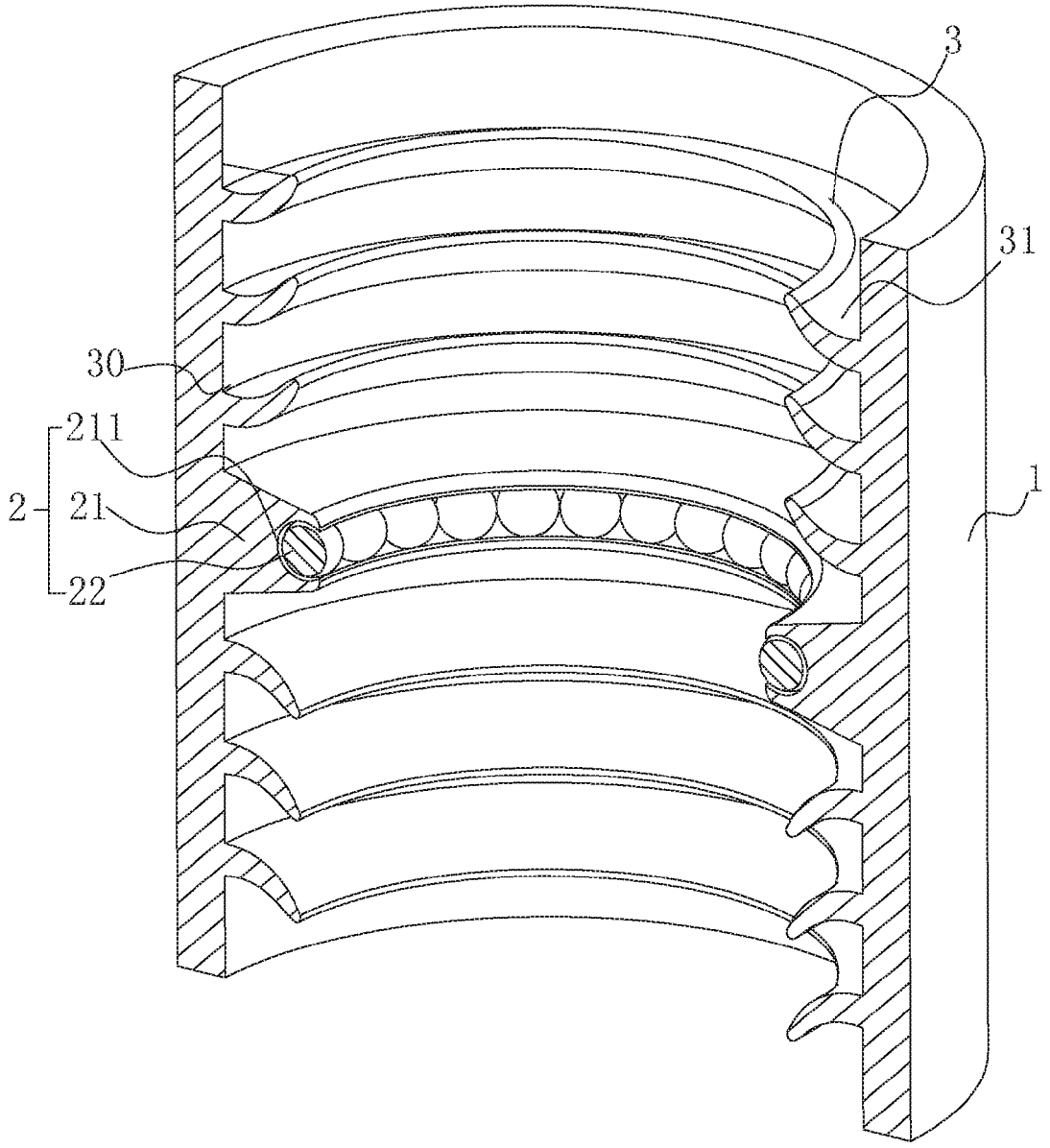
FIG. 8 is a half-cutaway schematic perspective view of the internal structure of embodiment 5.

Referring to FIG. 8, an insulating housing with integrated functions differs from embodiment 1 in that one side of each creepage-increasing ring 3 facing against the arc-leading ring 2 is provided with a ring groove 31 recessed toward the direction of the arc-leading ring 2 along the axial direction of the barrel-shaped shell 1. The side line of one side of the cross section of the ring groove 31 proximate to the arc-leading ring 2 takes the form of an arc curve, such that said side of the creepage-increasing ring 3 overally takes the form of an concave curved surface, correspondingly, the other side of the creepage-increasing ring 3 has a smooth transition of an convex curved surface, thereby not only further increasing the creepage distance but also raising the proportion of area that is not contaminated by evapotranspiration.

Figure 9:
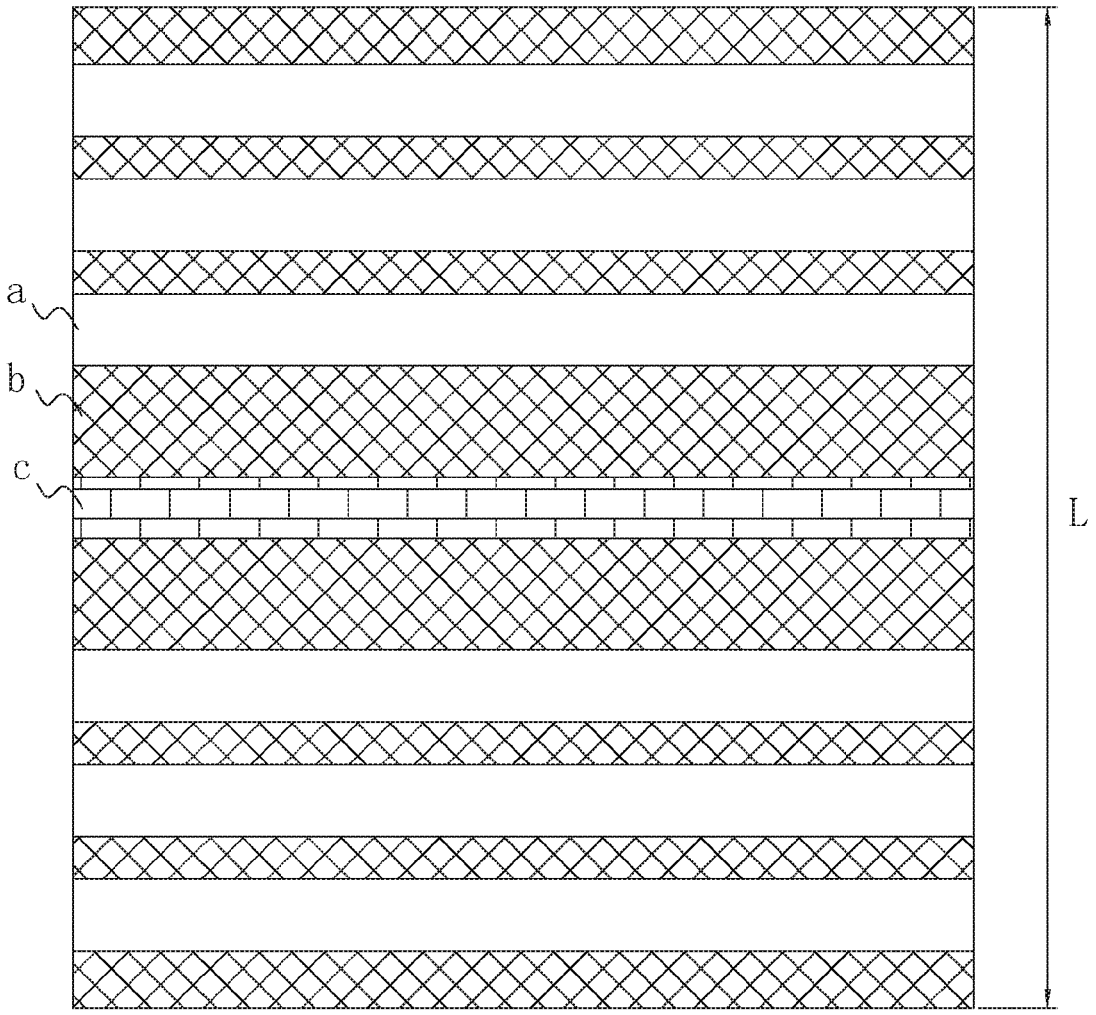
FIG. 9 is a deployed schematic view of the interior wall after arcing of the insulating housing of embodiment 5.

FIG. 9 shows a deployed view of the interior wall after arcing of the insulating housing. Firstly, the creepage distance L of the interior wall of the insulating housing is further increased as compared with embodiment 1, also, the proportion of the area occupied by the clean band a is raised, as can be seen in the figure, which means that the area that is not contaminated by the direct evapotranspiration of metal vapor due to the shielding of the creepage-increasing rings 3 is further expanded, such that the voltage withstanding and after arcing insulation level of the insulating housing are improved greatly while the after arcing electric insulation level of the vacuum interrupter is not decreased and is far higher than 75% decrease of the after arcing electric insulation level as specified in the national standard.

Embodiment 6

Figure 10:
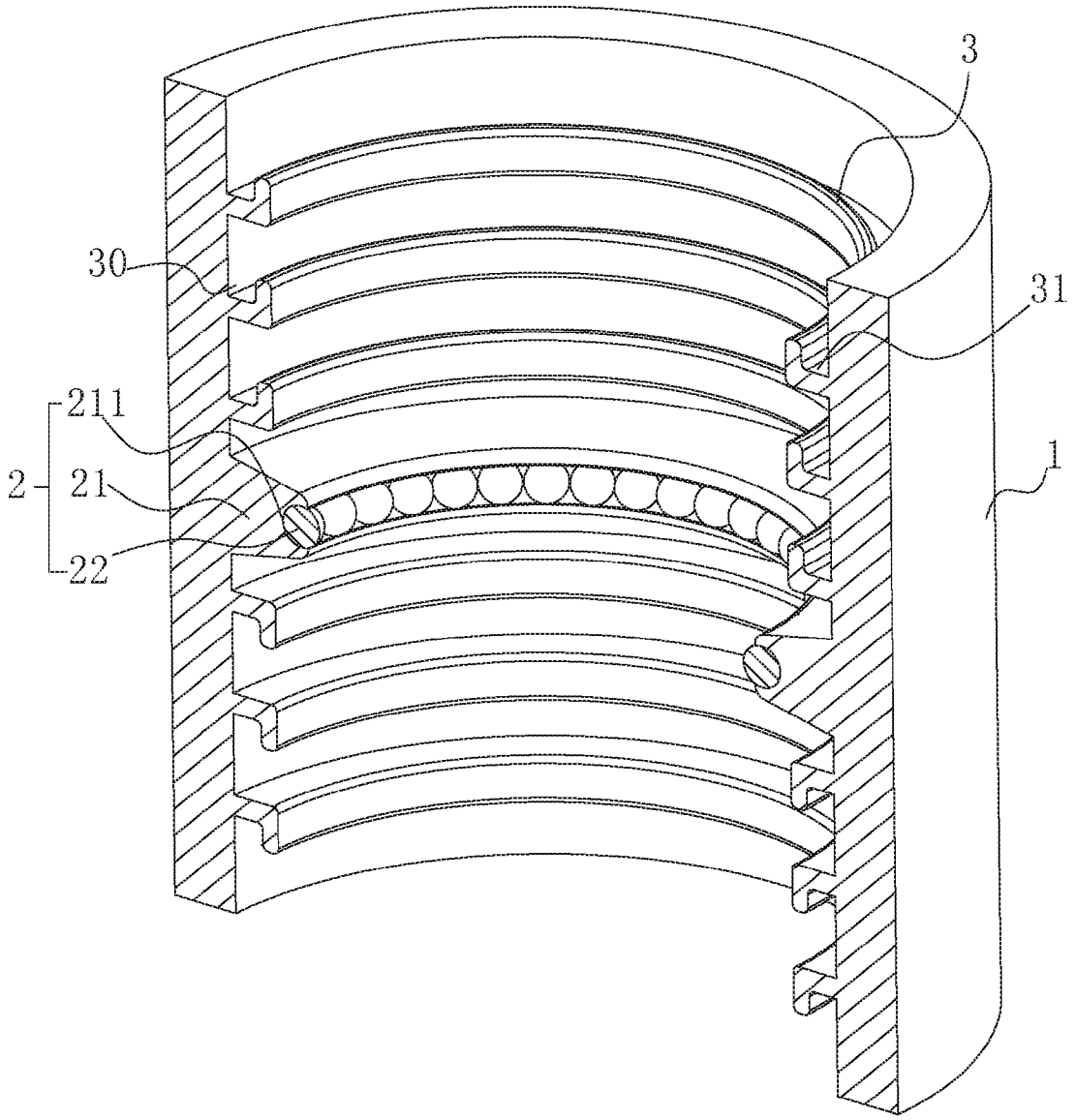
FIG. 10 is a half-cutaway schematic perspective view of the internal structure of embodiment 6.

Referring to FIG. 10, an insulating housing with integrated functions differs from embodiment 4 in that the cross section of the ring groove 31 is generally rectangular. Embodiment 6 can achieve a higher voltage withstanding performance and improved after arcing insulation performance.

Embodiment 7

Figure 11:
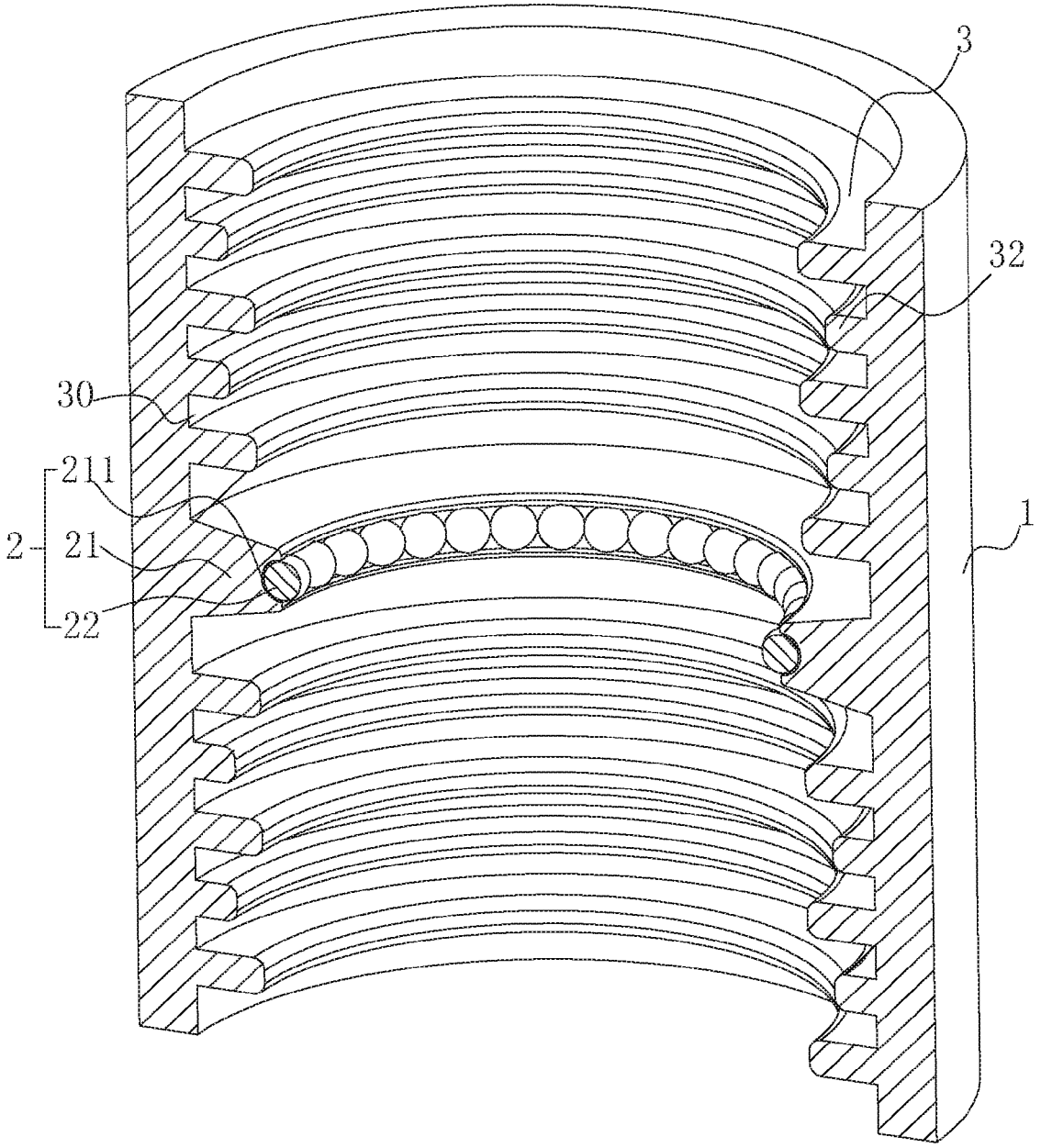
FIG. 11 is a half-cutaway schematic perspective view of the internal structure of embodiment 7.

Referring to FIG. 11, an insulating housing with integrated functions differs from embodiment 1 in that an inner creepage-increasing ring 32 is provided between neighboring creepage-increasing rings 3. A protruding height of the inner creepage-increasing ring 32 is lower than that of the creepage-increasing ring 3 along the radial direction of the barrel-shaped shell 1, thereby not only increasing the creepage distance, but also further raising the proportion of area that is not contaminated by the direct evapotranspiration of metal vapor (i.e., increasing the area of the clean band a) due to the surface of the inner creepage-increasing ring 32 being shielded by the creepage-increasing ring 3, such that the voltage withstanding and after arcing insulation performance of the insulating housing are further improved.

Embodiment 8

Figure 12:
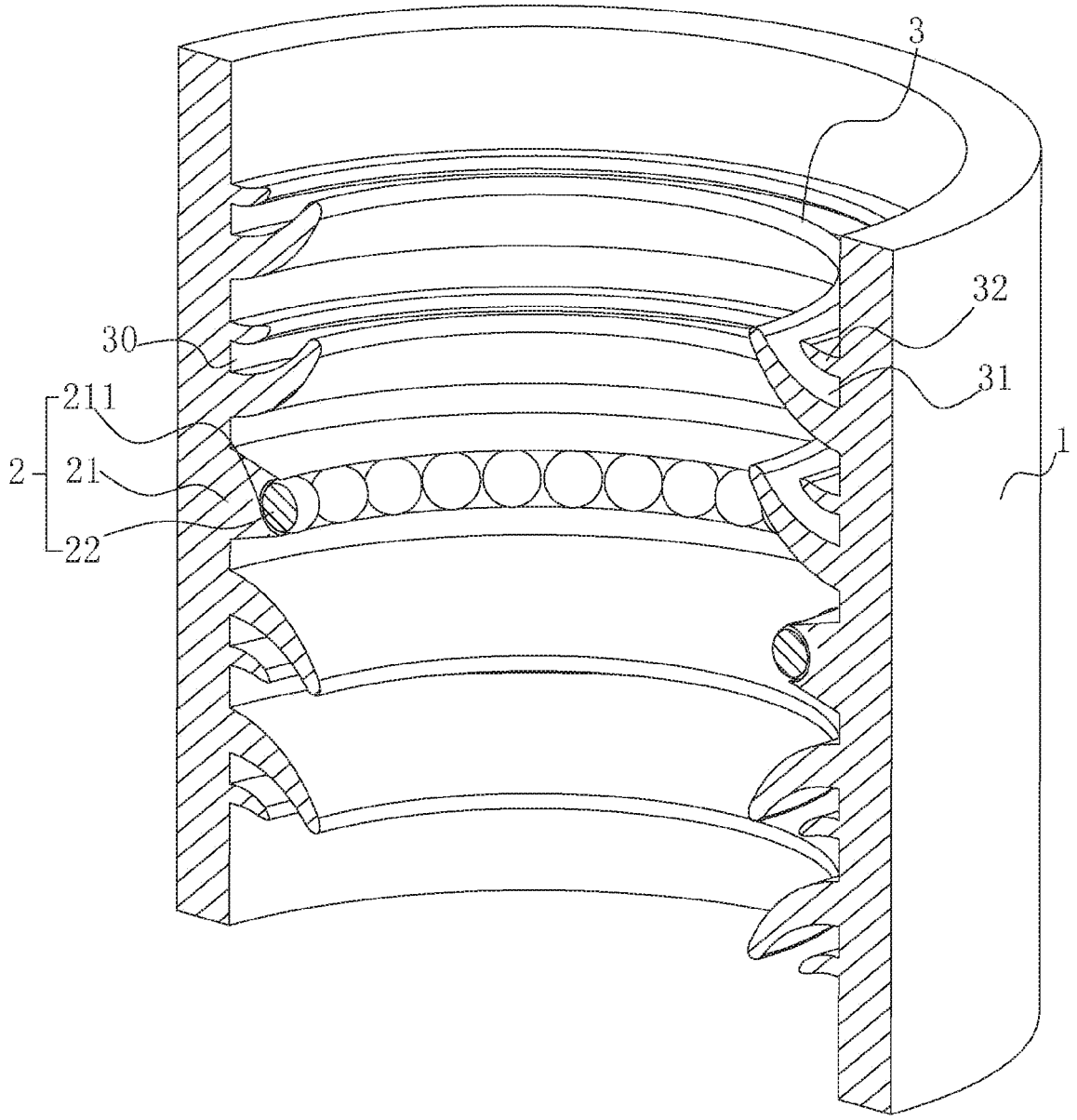
FIG. 12 is a half-cutaway schematic perspective view of the internal structure of embodiment 8.

Referring to FIG. 12, an insulating housing with integrated functions differs from embodiment 5 in that an inner creepage-increasing ring 32 is provided between neighboring creepage-increasing rings 3. A protruding height of the inner creepage-increasing ring 32 is lower than that of the creepage-increasing ring 3 along the radial direction of the barrel-shaped shell 1. The inner creepage-increasing ring 32 is placed within the ring groove 31. The surface of the inner creepage-increasing ring 32 is shielded by the creepage-increasing ring 3 and not contaminated by the evapotranspiration of metal vapor, thereby both increasing the creepage distance and raising the proportion of area that is not contaminated by the evapotranspiration, such that the voltage withstanding and after arcing insulation performance of the insulating housing are further improved.

Embodiment 9

Figure 13:
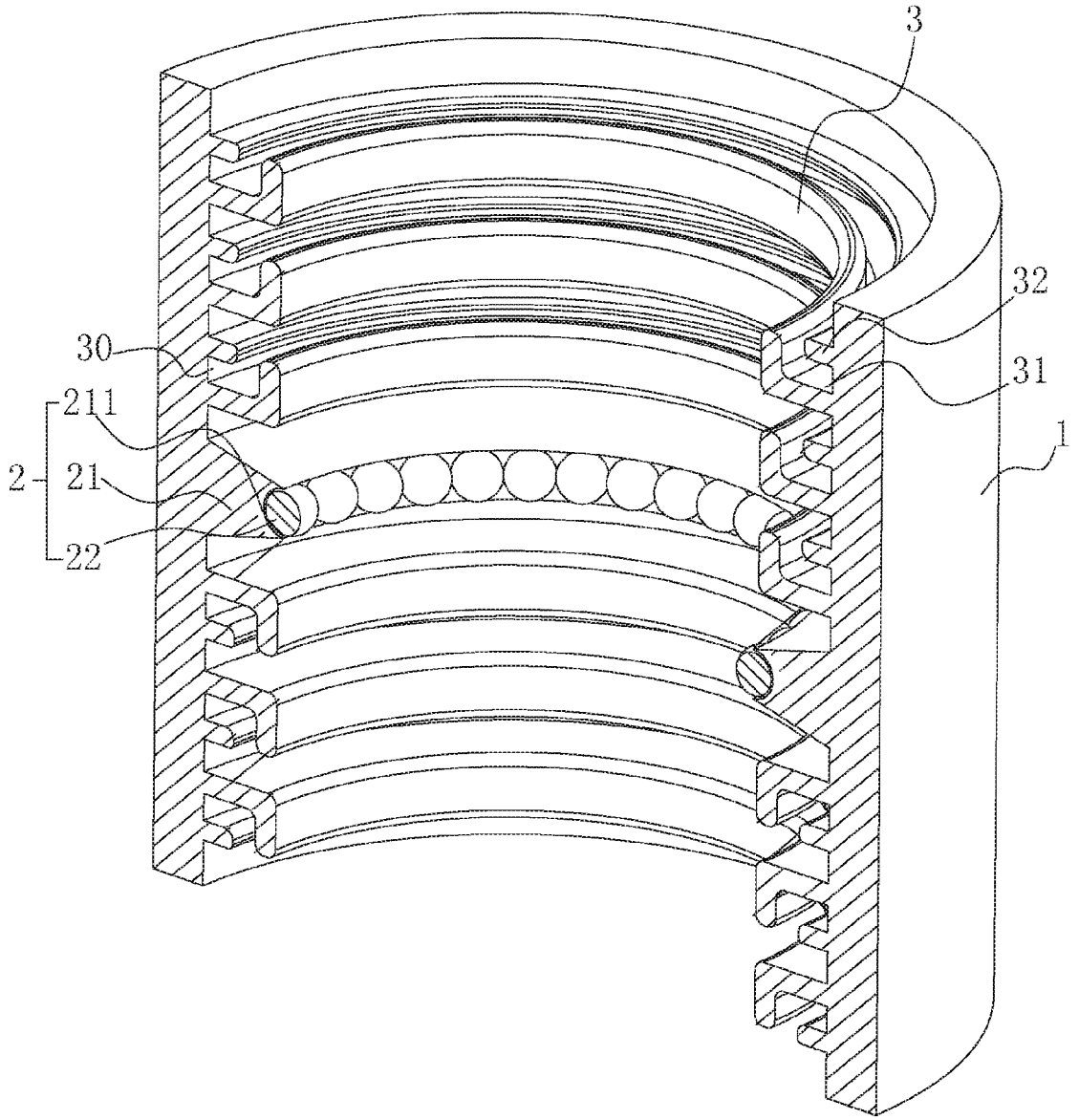
FIG. 13 is a half-cutaway schematic perspective view of the internal structure of embodiment 9.

Referring to FIG. 13, an insulating housing with integrated functions differs from embodiment 6 in that an inner creepage-increasing ring 32 is provided between neighboring creepage-increasing rings 3. A protruding height of the inner creepage-increasing ring 32 is lower than that of the creepage-increasing ring 3 along the radial direction of the barrel-shaped shell 1. The inner creepage-increasing ring 32 is placed within the ring groove 31. The surface of the inner creepage-increasing ring 32 is shielded by the creepage-increasing ring 3 and not contaminated by the evapotranspiration of metal vapor, thereby both increasing the creepage distance and raising the proportion of area that is not contaminated by the evapotranspiration, such that the voltage withstanding and after arcing insulation performance of the insulating housing are further improved.

Embodiment 10

Figure 14:
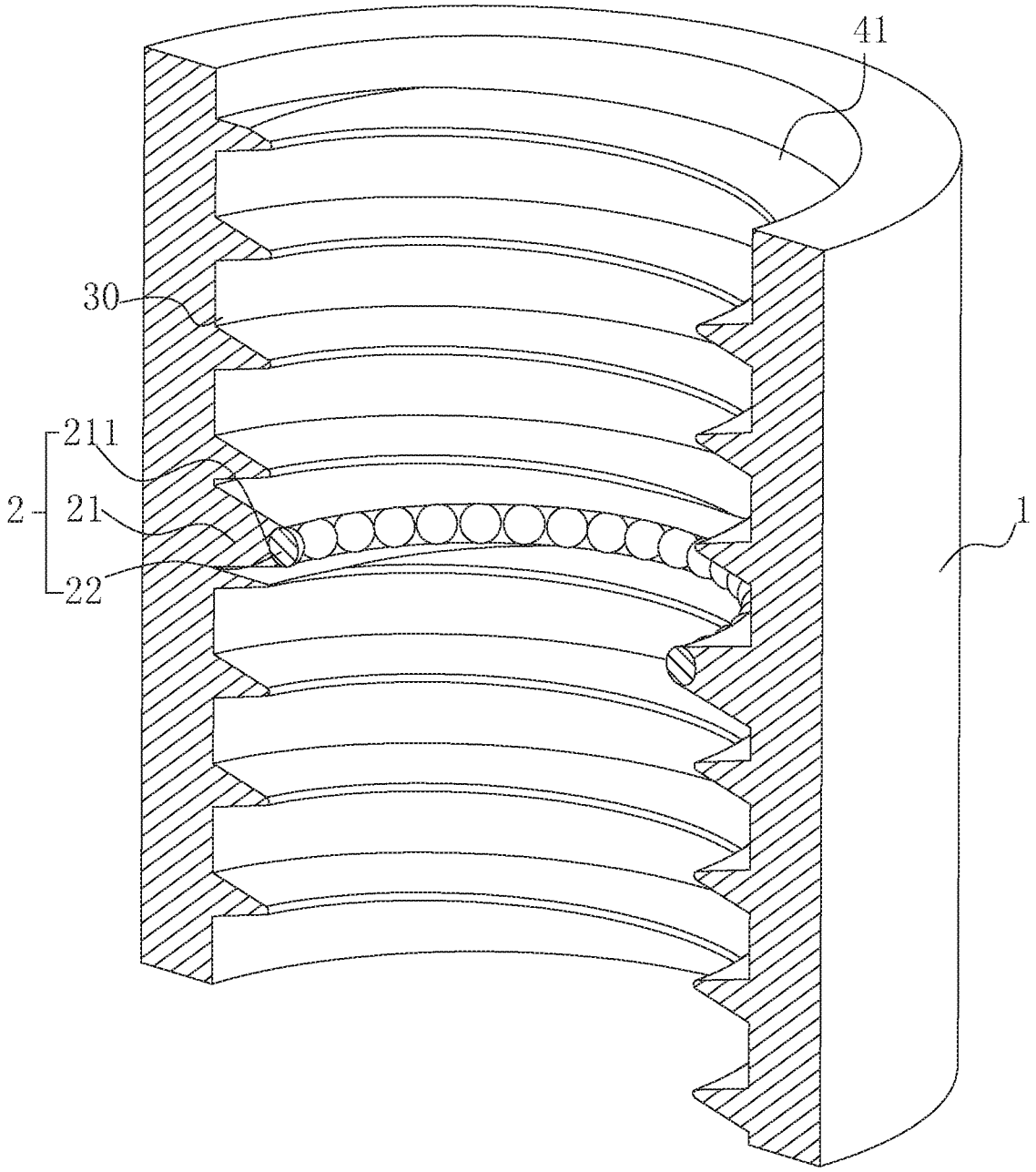
FIG. 14 is a half-cutaway schematic perspective of the internal structure of embodiment 10.

Referring to FIG. 14, an insulating housing with integrated functions differs from embodiment 1 in that the interior wall of the barrel-shaped shell 1 is provided with spiral reliefs 41 protruding towards the center instead of the creepage-increasing rings 3 in embodiment 1, thereby increasing the creepage distance. The spiral relief 41 is similar to a triangular internal thread structure. A part of the surface of the spiral relief 41 facing against the arc-leading ring 2 is not contaminated by the direct evapotranspiration of metal vapor, and has a high voltage withstanding and after arcing insulation performance. The recessed construction between neighboring thread teeth of the threaded reliefs 41 again constitutes a good mounting site 30 for a getter to be provided therein.

Embodiment 11

Figure 15:
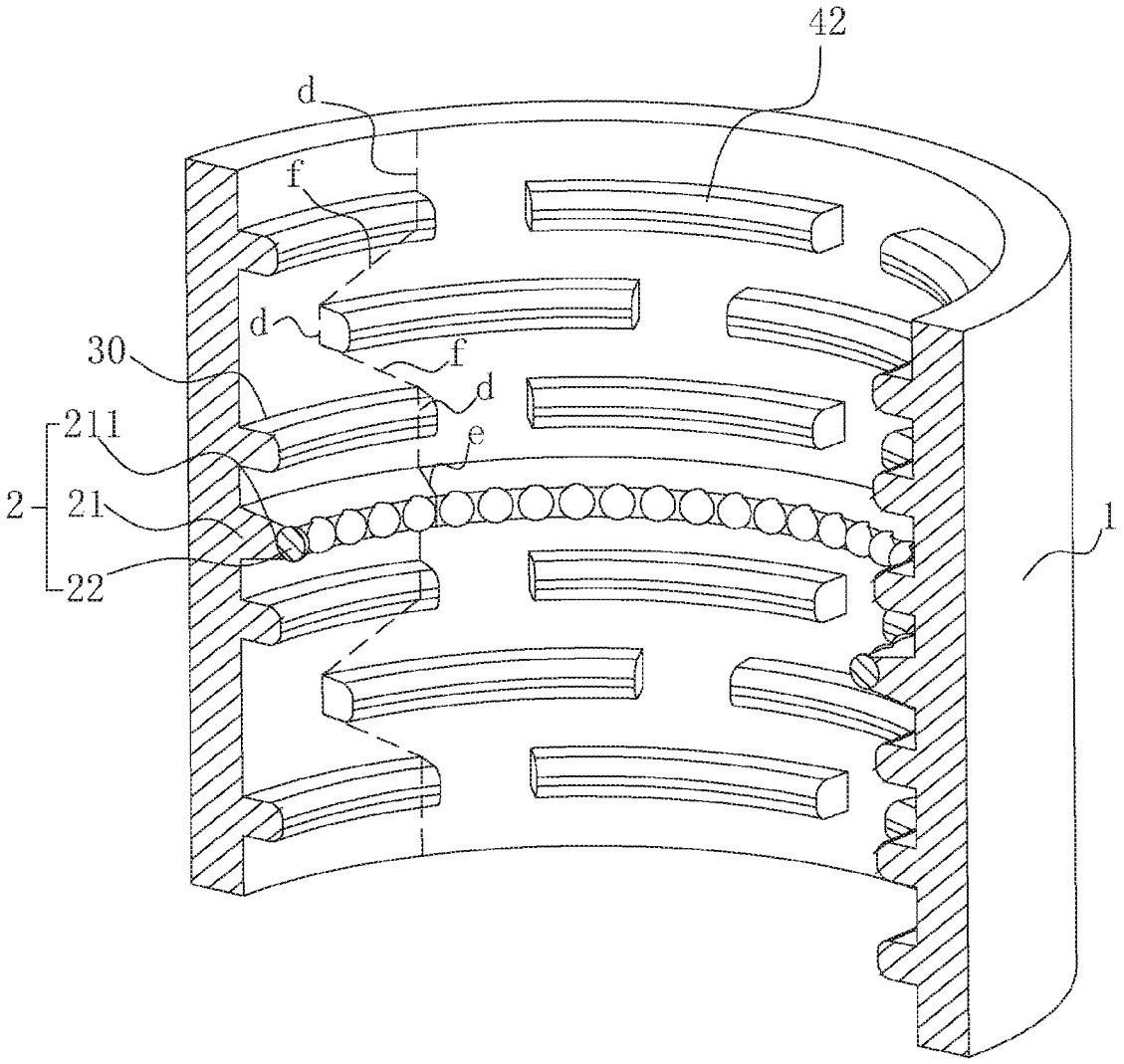
FIG. 15 is a half-cutaway schematic perspective view of internal structure of embodiment 11.

Referring to FIG. 15, an insulating housing with integrated functions differs from embodiment 1 in that the interior wall of the barrel-shaped shell 1 is provided with first labyrinth reliefs 42 protruding towards the center instead of the creepage-increasing rings 3 in embodiment 1. At this time, the path for the creepage distance is a mixed tortuous path of linear path d, flyover sub-path e and bypass sub-path f through the first labyrinth reliefs 42 (demonstrated in FIG. 15 in dash lines). Here, the term "bypass" refers to one in the deployed plane of the interior wall of the barrel-shaped shell 1. The starting point of the bypass sub-path f is the critical point at which the linear path d deviates from the axial direction of the barrel-shaped shell 1, and the ending point is the critical point at which returning to the linear path d is done. The plurality of bypass sub-paths f and flyover sub-paths e increase the creepage distance. A part of the surface of the first labyrinth relief 42 facing against the arc-leading ring 2 is not contaminated by the direct evapotranspiration of metal vapor, and at the same time has a high voltage withstanding and after arcing insulation performance.

Embodiment 12

Figure 16:
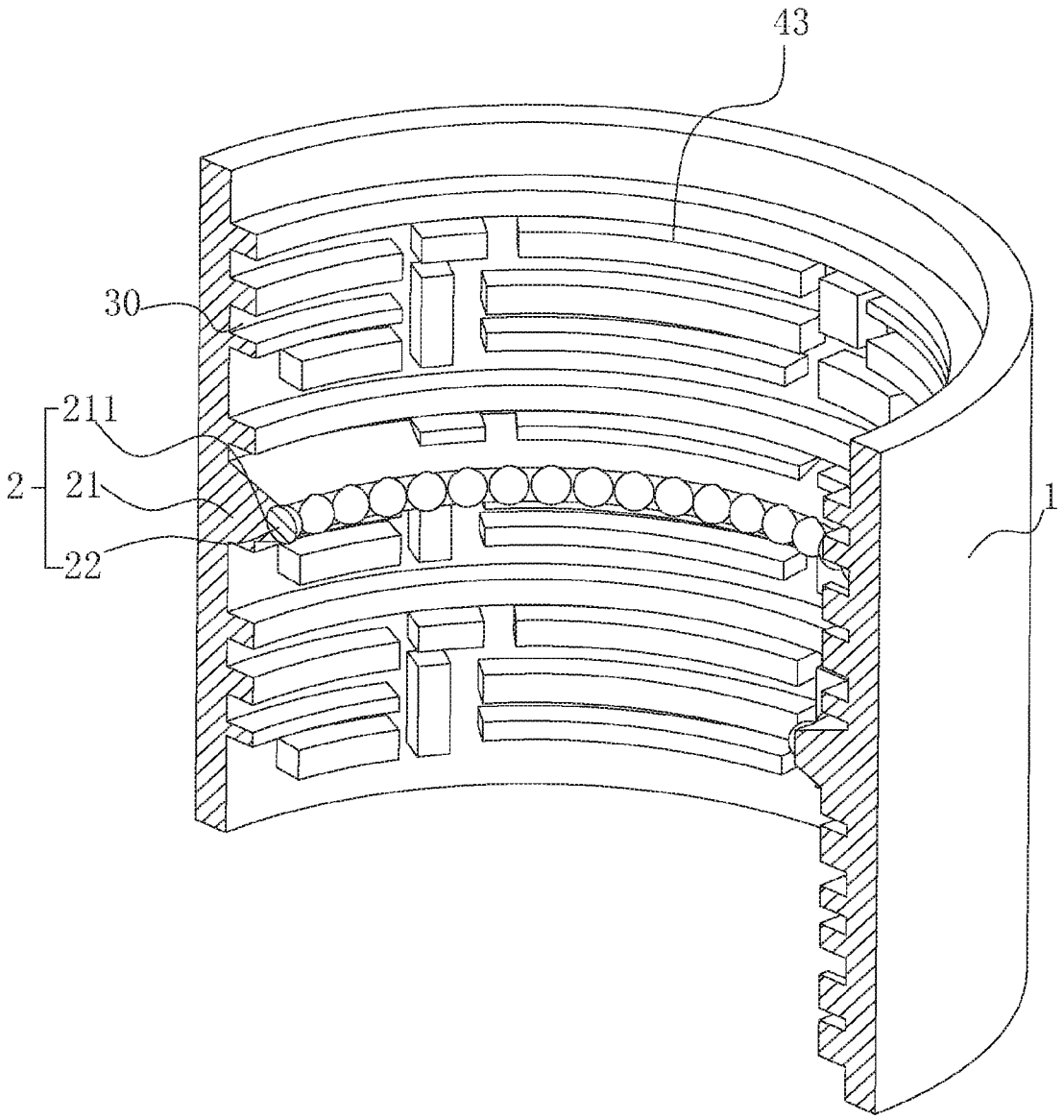
FIG. 16 is a half-cutaway schematic perspective view of the internal structure of embodiment 12.

Referring to FIG. 16, an insulating housing with integrated functions differs from embodiment 1 in that the interior wall of the barrel-shaped shell 1 is provided with second labyrinth reliefs 43 protruding towards the center instead of the creepage-increasing rings 3 in embodiment 1. At this time, the creepage distance is the bypass or flyover path through the second labyrinth reliefs 43, thereby increasing the creepage distance. A part of the surface of the second labyrinth relief 43 facing against the arc-leading ring 2 is not contaminated by the direct evapotranspiration of metal vapor, and has a high voltage withstanding and after arcing insulation performance.

Embodiment 13

Figure 17:
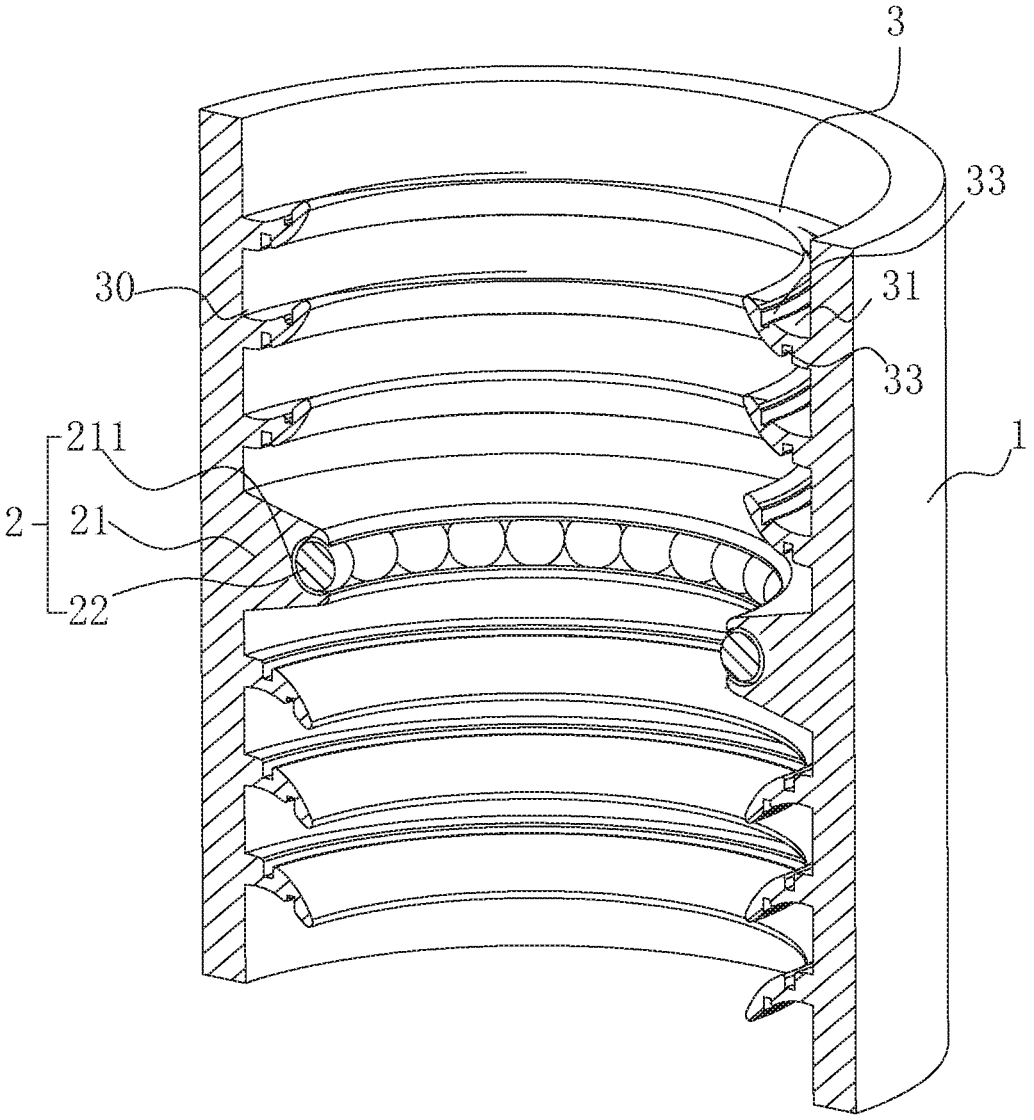
FIG. 17 is a half-cutaway schematic perspective view of the internal structure of embodiment 13.

Referring to FIG. 17, an insulating housing with integrated functions differs from embodiment 5 in that both the concave and convex curved surfaces of the creepage-increasing ring 3 are provided with an annular embedding groove 33, such that the creepage distance and the area, that is not contaminated by the direct evapotranspiration of metal vapor are further increased.

Embodiment 14

Figure 18:
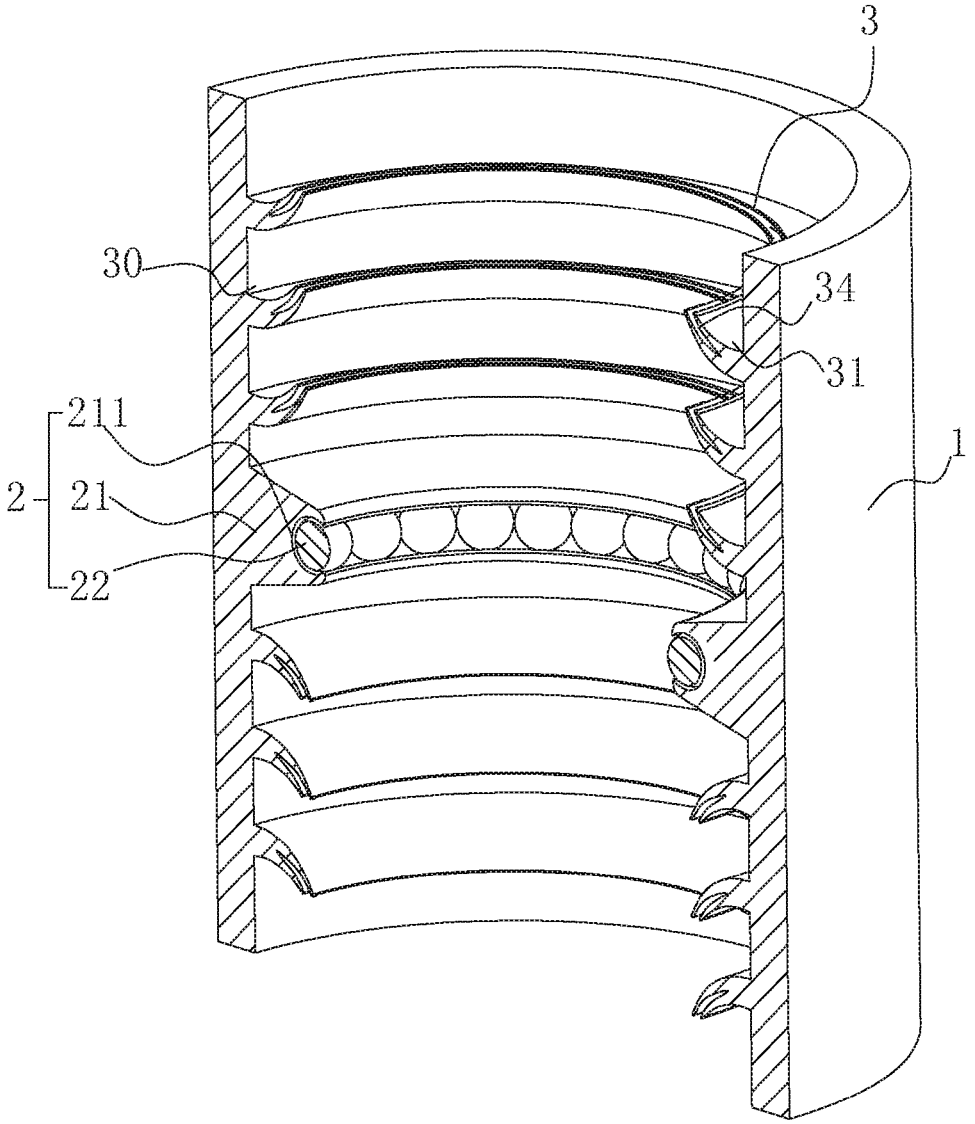
FIG. 18 is a half-cutaway schematic perspective view of the internal structure of embodiment 14.

Referring to FIG. 18, an insulating housing with integrated functions differs from embodiment 5 in that the creepage-increasing ring 3 is embedded with a ring undercut 34 from the edge of its inner diameter towards the direction of its outer diameter, such that the creepage distance and the area that is not contaminated b the direct evapotranspiration of metal vapor are further increased.

Embodiment 15

Figure 19:
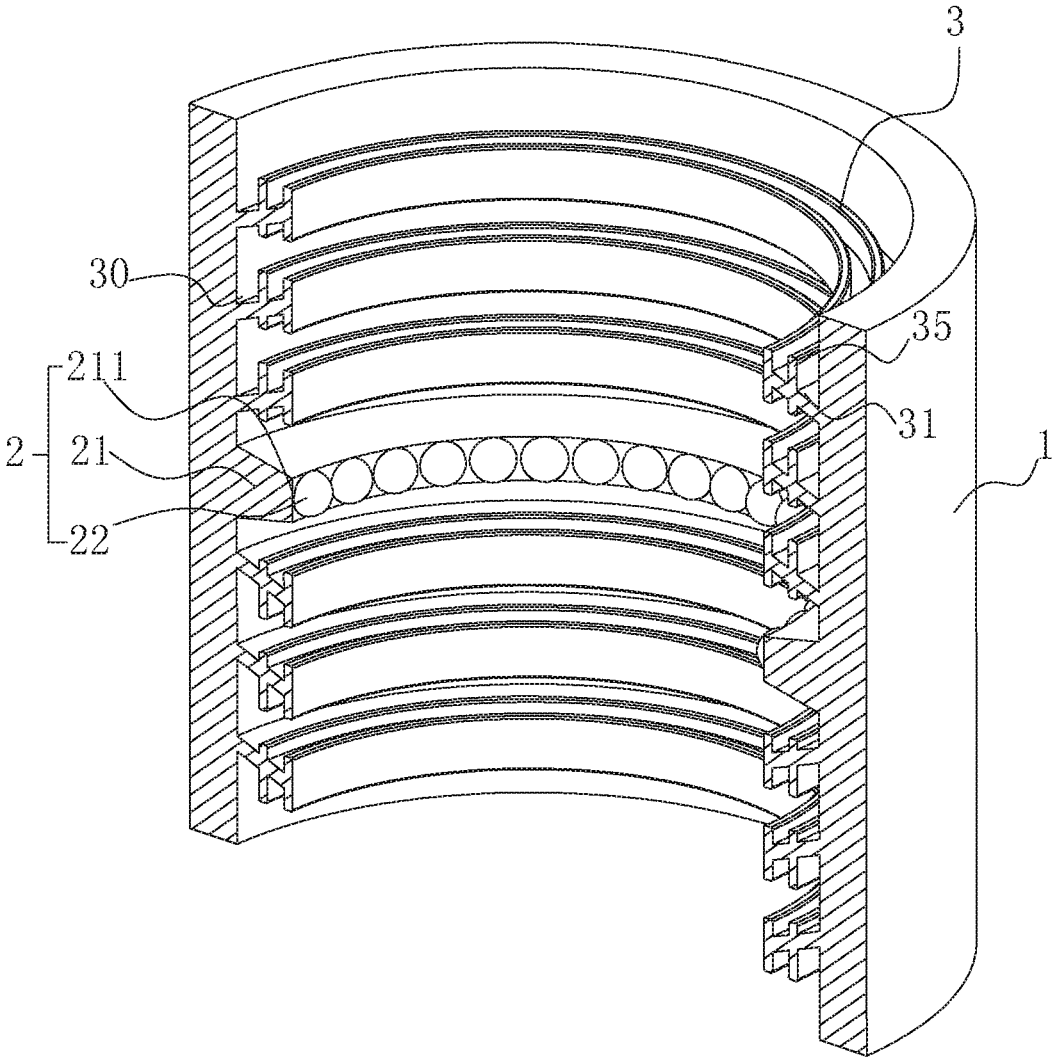
FIG. 19 is a half-cutaway schematic perspective view of the internal structure of embodiment 15.

Referring to FIG. 19, an insulating housing with integrated functions differs from embodiment 1 in that the creepage-increasing rings 3 are somewhat inclined in the direction facing against the arc-leading ring 2 at a certain angle (5-15 degrees), and both the upper and lower end faces of the creepage-increasing ring 3 are provided with ring sheets 35, with the radial spacing between neighboring ring sheets 35 being between 8-15 mm, such that the creepage distance and the area that is not contaminated by the direct evapotranspiration of metal vapor are further increased.

Embodiment 16

Figure 20:
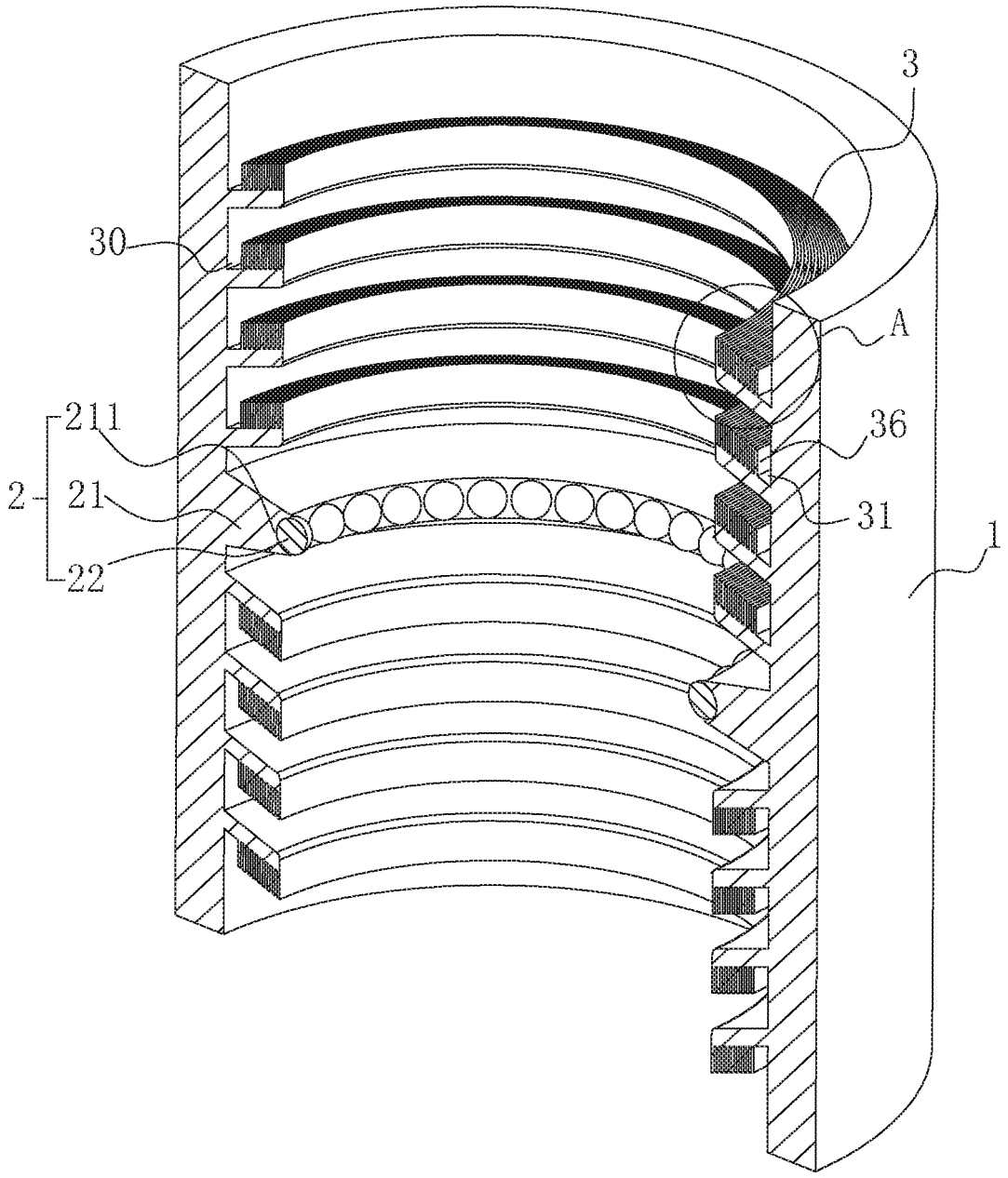
FIG. 20 is a half-cutaway schematic perspective view of the internal structure of embodiment 16.

Referring to FIG. 20, an insulating housing with integrated functions differs from embodiment 1 in that the creepage-increasing rings 3 are somewhat inclined in the direction facing against the arc-leading ring 2 at a certain angle (5-15 degrees), and the end face on one side of the creepage-increasing rings 3 facing against the arc-leading ring is provided with annular clearance sheets 36.

Figure 21:
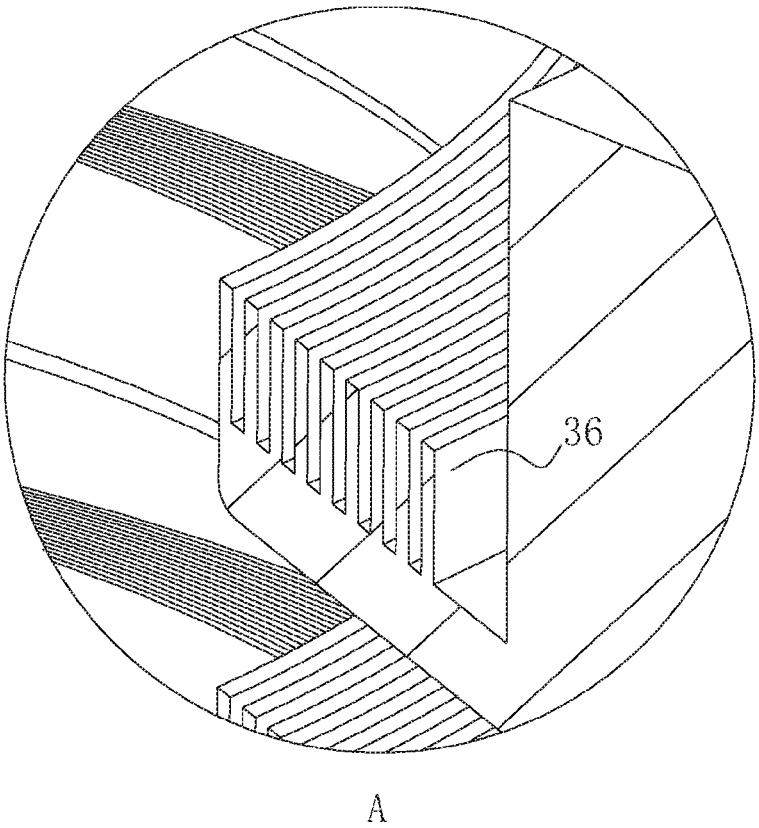
FIG. 21 is an enlarged view of part A of embodiment 16.

Referring to FIG. 21, the radial clearance between neighboring clearance sheets 36 is between 0.8-1.0 mm. The plurality of clearance sheets 36 are closely arranged such that the common cross section of the creepage-increasing rings 3 and the clearance sheets 36 takes the shape of a comb.

Smaller clearances significantly improve the voltage withstanding. Taking two sheets of insulative material spaced 10 mm as an example, the voltage withstanding grade between the two sheets of insulative material can reach 10 KV, however, separating the same 10 mm spacing into smaller equal parts by the clearance sheets 36 with a spacing of 1 mm between every neighboring clearance sheets 36 can make the voltage withstanding grade reach 40 KV to 80 KV and higher, that is, the voltage withstanding in the space or spacing of same size is increased by times, which greatly increase the voltage withstanding of the vacuum interrupter.

Embodiment 17

Figure 22:
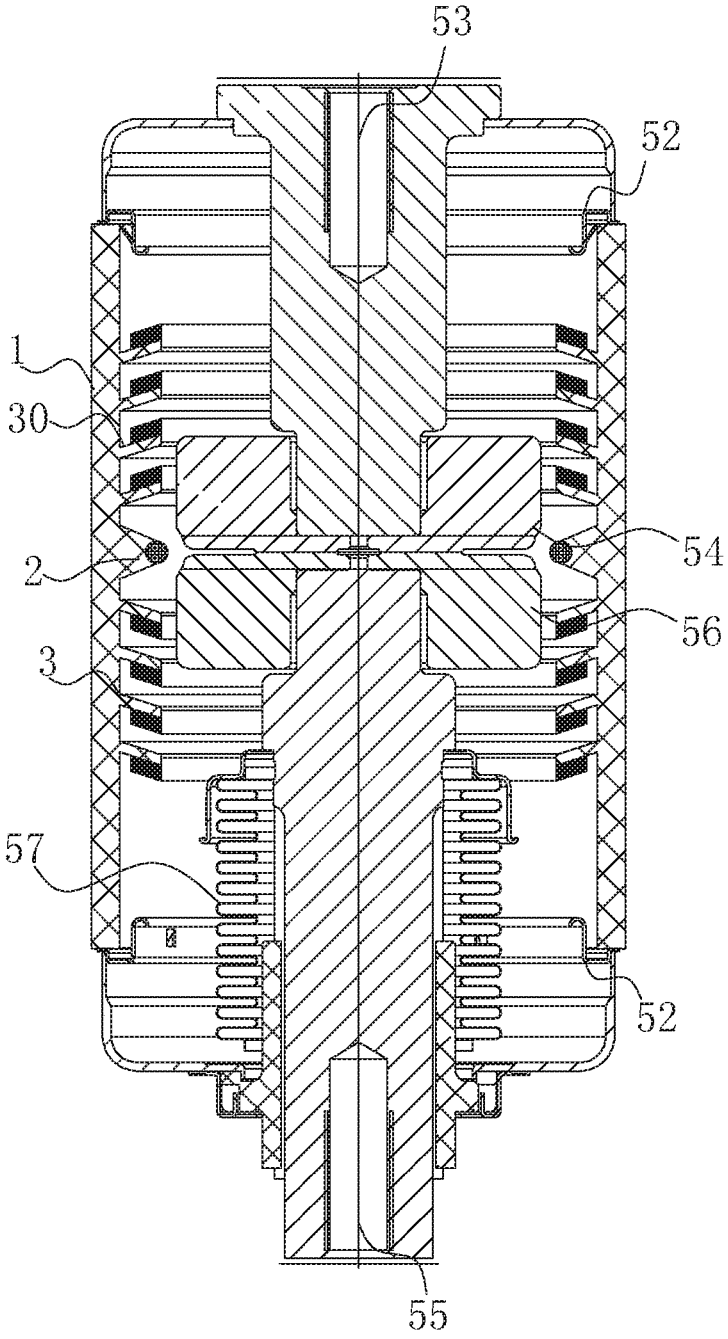
FIG. 22 is a cutaway view of embodiment 17.

Referring to FIG. 22, a vacuum interrupter comprises the insulating housing described in embodiment 16. As can be seen in the figure, a plurality of creepage-increasing rings 3 in place of a middle shielding cap system are provided in the interior of the vacuum interrupter, which forms a plurality of flyover paths e in the interior wall of the barrel-shaped shell 1, increasing the creepage distance and improving the voltage withstanding of the vacuum interrupter, and makes the creepage-increasing rings 3 to function to mask the interior wall of the barrel-shaped shell 1, reducing the contamination due to the direct evapotranspiration of metal vapor while the after arcing insulation level is not decreased. The mounting site 30 constituted by the recessed construction between neighboring creepage-increasing rings 3 is coated with a slurry getter, such that the insulating housing is equipped with the function of the getter. Also, the arc-leading ring 2 is provided in the interior wall of the barrel-shaped shell 1 within the range of the gap between contacts, such that the short-circuit interrupting capability of the vacuum interrupter is improved significantly.

The above vacuum interrupter whose insulating housing will improve integration of a variety of functions including voltage withstanding, after arcing insulation level, short-circuit interrupting capability and reliability of vacuum degree, changes the existing traditional thinking and becomes an technical route necessary to be used in vacuum interrupter products in the field of ultra-high voltage and with non-decreasing after arcing insulation level.

Embodiment 18

A method for manufacturing an insulating housing with integrated functions of any one of embodiments 1 to 16, comprising the following steps:

modeling: modeling the insulating housing with integrated functions to be manufactured to obtain a 3D model;

ingredients mixing: mixing uniformly 60-99 parts by mass of $Al_2O_3$, 3-30 parts by mass of $MnO_2$, 2-20 parts by mass of $SiO_2$, 40-150 parts by mass of powdered polyethylene wax, and 25-100 parts by mass of powdered inorganic silicate to obtain a raw material;

blank-making: importing the 3D model into a 3D printing apparatus, and making a blank according to the 3D model and employing the raw material; and sintering: sintering the blank into a finished product.

It has been difficult for the existing vacuum interrupter to be adapted to high voltage and ultra-high voltage. This is largely limited by the existing methods for manufacturing the insulating housing, since it is difficult to manufacture an insulating housing having a complex three-dimensional construction in the existing methods for machining the insulating housing, such as hot pressure casting, isostatic pressing, etc., due to the limitations of demolding and so on. This limits the creative ability of persons skilled in the art, rendering that persons skilled in the art do not put their efforts to improve the structural optimization of the insulating housing itself, but to other aspects, such as to improve the shielding cap. However, emergence of the 3D printing technique solves this problem commendably. Manufacturing an insulating housing having a complex three-dimensional construction by employing the 3D printing technique improves the voltage withstanding of the insulating housing significantly, pushing the vacuum interrupter to develop towards a more advanced technique.

Embodiment 19

A method for manufacturing an insulating housing with integrated functions of any one of embodiments 1 to 16, comprising the following steps:

molds configuring: dividing the insulating housing with integrated functions to be manufactured into a number of demoldable components, and manufacturing a mold for each component or each kind of component separately;

ingredients mixing: mixing uniformly 60-99 parts by mass of $Al_2O_3$, 3-30 parts by mass of $MnO_2$, and 2-20 parts by mass of $SiO_2$ to obtain a powder material;

slurrying: adding the powder material into a melt wax and mixing and stirring it uniformly to obtain a slurry;

molding: injecting the slurry into the molds, and molding it through hot pressure casting to obtain a number of component blanks;

demolding: demolding the number of component blanks;

dewaxing and cooling: burying the number of component blanks into an absorbent, raising the temperature to 900-1100° C., and cooling the number of component blanks after dewaxing thereof;

trimming: trimming the number of component blanks to obtain a desired shape;

assembling: adhering the number of component blanks into a complete insulating housing blank to be manufactured; and sintering: putting the insulating housing blank into a sintering furnace and sintering it into a finished product.

With a thinking style of calculus, an insulating housing having a complex three-dimensional construction is divided into a number of demoldable components, and each component blank is adhered and assembled into a complete insulating housing blank after being molded separately through hot pressure casting, and is sintered to obtain a finished product. The above operations overcome the technical challenge that an insulating housing of a complex construction cannot be manufactured through hot pressure casting as generally thought in the prior art, widening the thinking in the field of insulating housing manufacturing, while providing significant help for the vacuum interrupter to develop towards advanced high voltage and ultra-high voltage.

Embodiment 20

Figure 23:
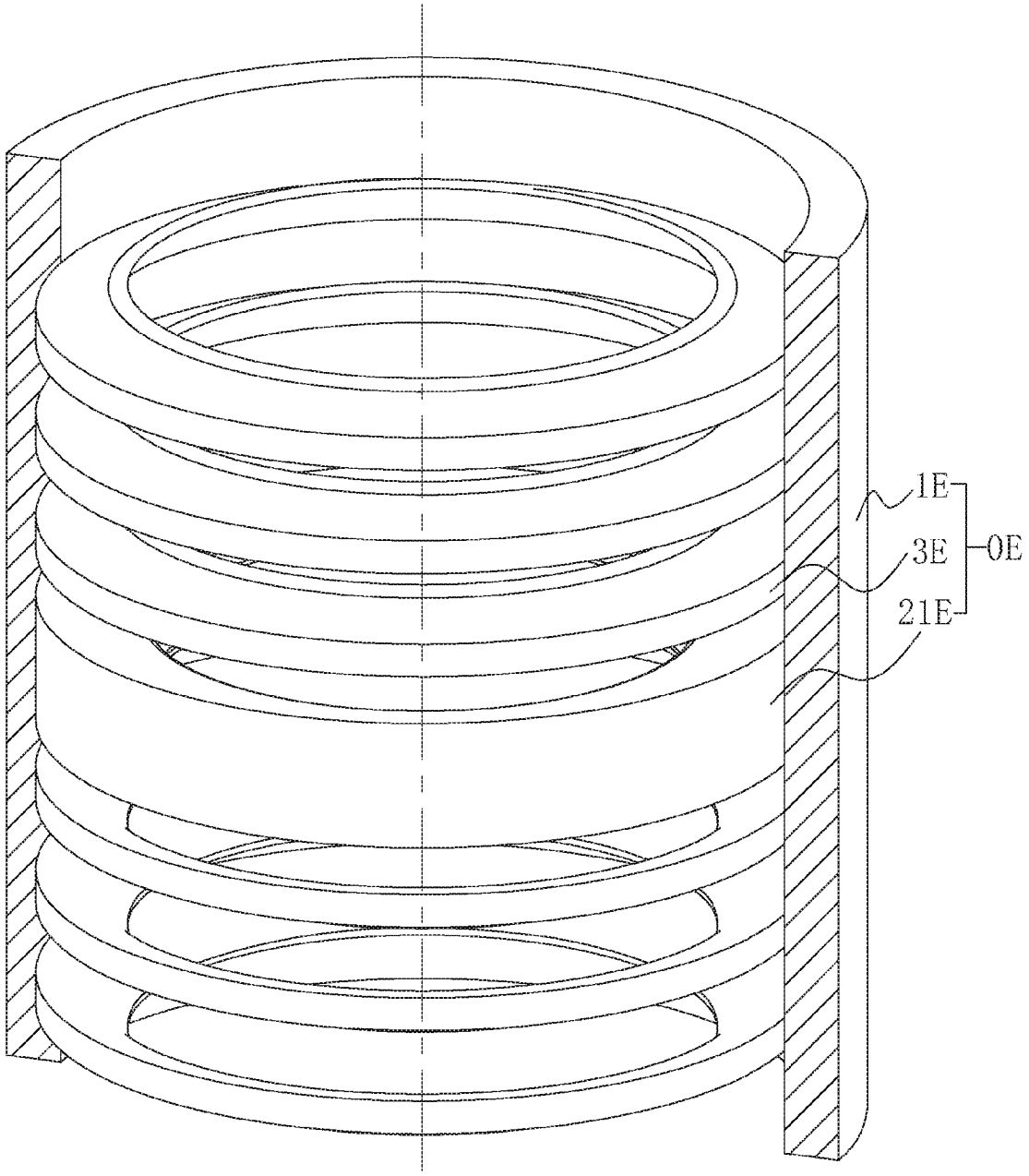
FIG. 23 is a cutaway view of the insulating housing blank of embodiment 20.

Referring to FIG. 23, a method for manufacturing the insulating housing with integrated functions as shown by embodiment 4, comprising the following steps:

molds configuring: virtualizing the model of embodiment 4 and dividing it into three components, a barrel-shaped shell 1, a creepage-increasing rings 3 and a mounting ring 21, and configuring based on the three components respectively:

mold 1, having a mold cavity used for molding the barrel-shaped shell 1;

mold 2, having a mold cavity used for molding the creepage-increasing rings 3;

mold 3, mold cavity used for molding the mounting ring 21;

ingredients mixing: mixing uniformly 60-99 parts by mass of $Al_2O_3$, 3-30 parts by mass of $MnO_2$, and 2-20 parts by mass of $SiO_2$ to obtain a powder material;

slurrying: adding the powder material into a melt wax and mixing and stirring it uniformly to obtain a slurry;

molding: injecting the slurry into mold 1, mold 2 and mold 3 respectively, and molding it through hot pressure casting to obtain a barrel-shaped shell blank 1E, creepage-increasing ring blank 3E and mounting ring blank 21E;

demolding: demolding the barrel-shaped shell blank 1E, creepage-increasing ring blank 3E and mounting ring blank 21E respectively;

dewaxing and cooling: burying the barrel-shaped shell blank 1E, creepage-increasing ring blank 3E and mounting ring blank 21E into an absorbent, raising the temperature to 900-1100° C., and cooling them after dewaxing thereof;

trimming: trimming the barrel-shaped shell blank 1E, creepage-increasing ring blank 3E and mounting ring blank 21E to obtain an desired shape;

assembling: adhering the barrel-shaped shell blank 1E, creepage-increasing ring blank 3E and mounting ring blank 21E into a complete insulating housing blank 0E as shown by FIG. 4; and sintering: putting the insulating housing blank 0E into a sintering furnace and sintering it into a finished product.

Embodiment 21

A method for manufacturing an insulating housing with integrated functions according to any one of embodiments 1 to 16, comprising the following steps:

molds configuring: dividing the insulating housing with integrated functions to be manufactured into a number of demoldable components, and manufacturing a mold for each component or each kind of component separately;

ingredients mixing: mixing uniformly 60-99 parts by mass of $Al_2O_3$, 3-30 parts by mass of $MnO_2$, 2-20 parts by mass of $SiO_2$ and 9-15 parts by mass of adhesive to obtain a powder material;

ingredients filling: pouring above powder material into the individual molds, and drawing air out;

isostatic pressing: placing each mold filled with the ingredients within a pressurized container, and molding it with a hot or cold or warm isostatic pressing technique to obtain various component blanks;

demolding: demolding the number of component blanks;

trimming: trimming the number of component blanks to obtain a desired shape;

assembling: adhering the number of component blanks into a complete insulating housing blank to be manufactured; and sintering: putting the insulating housing blank into a sintering furnace and sintering it into a finished product.

In the field of producing and manufacturing an insulating housing by employing an isostatic pressing technique, there is also a limitation that only the insulating housing of a simple three-dimensional construction can be machined by a common mold, while an insulating housing of a complex three-dimensional construction is difficult to machine. With a thinking style of calculus, an insulating housing having a complex three-dimensional construction is divided into a number of demoldable components, and each component blank is adhered and assembled into a complete insulating housing blank after being molded separately through an isostatic pressing technique, and is sintered to obtain a finished product. The above operations overcome the technical challenge that an insulating housing of a complex construction cannot be manufactured through isostatic pressing as generally thought in the prior art, widening the thinking in the field of insulating housing manufacturing, while providing significant help for the vacuum interrupter to develop towards advanced high voltage and ultra-high voltage.

In the above embodiments 19 to 21, the term "dividing" is a virtualized concept, such as employing drawings or a three-dimensional software to build a model of an insulating housing to be manufactured, and dividing it into a plurality of components virtually; the term "trimming" refers to machining, since the molded blank has a certain hardness, and the molded component blank or insulating housing blank can be machined by employing a machine tool to obtain a desired shape to manufacture various insulating housings having a complex three-dimensional construction; and the contacts on the arc-leading ring 2 are mounted and connected by employing a ceramic-to-metal soldering technique after a finished product is sintered.

An insulating housing with integrated functions comprises a barrel-shaped shell, an interior wall of which being provided with a protruded or recessed uneven texture configured to increase a creepage distance between both axial ends of the barrel-shaped shell, the path of the creepage distance formed by the protruded or recessed uneven texture having more than two flyover or bypass sub-paths, such that the creepage distance is increased, and the voltage withstanding is increased. Meanwhile, by employing a construction of creepage-increasing rings, not only the creepage distance is increased greatly, but also the barrel-shaped shell is avoided from full-interior wall contamination by metal vapor evapotranspiration. Thus, under the double effects of a greater creepage distance and a greater proportion of uncontaminated area, the voltage withstanding and after arcing insulation level of the insulating housing with integrated functions are improved greatly, while the after arcing electric insulation level of the vacuum interrupter is not decreased, such that the insulating housing with integrated functions and the vacuum interrupter is developing towards high voltage and ultra-high voltage.

The invention claimed is:

1. An insulating housing, comprising:

a barrel-shaped shell, wherein an interior wall of the barrel-shaped shell is provided with a protruded or recessed uneven texture configured to increase a creepage distance between both axial ends of the barrel-shaped shell, a path of the creepage distance formed by the protruded or recessed uneven texture having more than two flyover or bypass sub-paths;

wherein the protruded or recessed uneven texture comprises a plurality of creepage-increasing rings provided concentrically with the barrel-shaped shell, the creepage-increasing rings being in a form of circular rings protruding from the interior wall to the center of the barrel-shaped shell, neighboring creepage-increasing rings being provided along axial clearances of the barrel-shaped shell, portions of cross-sectional profiles of the creepage-increasing rings except for those intersecting with the barrel shaped shell constituting the flyover sub-path;

wherein taking a cross section in which an axial midpoint of the barrel-shaped shell lies as a reference plane, each side of the creepage-increasing rings located on both sides of the reference plane facing against the reference plane is formed with a ring groove, the ring groove being recessed along an axial direction of the barrel-shaped shell towards a direction of the reference plane;

wherein the interior wall of the barrel-shaped shell within a range of a gap of contacts is provided with an arc-leading ring used to draw arc between the contacts; and the arc-leading ring comprises an annular mounting ring, an inner circumference of which is formed with an annular engaging groove, wherein the engaging groove is provided with a plurality of spherical contacts that are uniformly distributed in the engaging groove, and the spherical contacts are made of copper-chromium alloy.

2. The insulating housing according to claim 1, wherein an inner creepage-increasing ring is provided between the neighboring creepage-increasing rings, a protruding height of the inner creepage-increasing ring being lower than that of the creepage-increasing rings along a radial direction of the barrel-shaped shell.

3. The insulating housing according to claim 1, wherein a recessed construction formed between the neighboring creepage-increasing rings constitutes a mounting site used for a getter to attach thereto.

4. A vacuum interrupter comprising the insulating housing according to claim 1.

5. A method for manufacturing the insulating housing according to claim 1, comprising the following steps:

modeling: modeling the insulating housing to be manufactured to obtain a 3D model;

ingredients mixing: mixing uniformly 60-99 parts by mass of $Al_2O_3$, 3-30 parts by mass of $MnO_2$, 2-20 parts by mass of $SiO_2$, 40-150 parts by mass of powdered polyethylene wax, and 25-100 parts by mass of powdered inorganic silicate to obtain a raw material;

blank-making: importing the 3D model into a 3D printing apparatus, and making a blank according to the 3D model and employing the raw material; and sintering: sintering the above blank into a finished product.

6. A method for manufacturing the insulating housing according to claim 1, comprising the following steps:

molds configuring: dividing the insulating housing to be manufactured into a number of demoldable components, and manufacturing a mold for each component or each kind of component separately;

ingredients mixing: mixing uniformly 60-99 parts by mass of Al2O3, 3-30 parts by mass of MnO2, and 2-20 parts by mass of SiO2 to obtain a powder material;

slurrying: adding the powder material into a melt wax, and mixing and stirring the powder material uniformly to obtain a slurry;

molding: injecting the slurry into the mold, and molding the slurry through hot pressure casting to obtain a number of component blanks;

demolding: demolding the number of component blanks;

dewaxing and cooling: burying the number of component blanks into an absorbent, raising a temperature to 900-1100° C., and cooling the number of component blanks after dewaxing thereof;

trimming: trimming the number of component blanks to obtain a desired shape;

assembling: adhering the number of component blanks into a complete insulating housing blank to be manufactured; and sintering: putting the insulating housing blank into a sintering furnace and sintering the insulating housing blank into a finished product.

7. A method for manufacturing the insulating housing according to claim 1, comprising the following steps:

molds configuring: dividing the insulating housing to be manufactured into a number of demoldable components, and manufacturing a mold for each component or each kind of component separately;

ingredients mixing: mixing uniformly 60-99 parts by mass of Al2O3, 3-30 parts by mass of MnO2, 2-20 parts by mass of SiO2, and 9-15 parts by mass of adhesive to obtain a powder material;

ingredients filling: pouring the powder material into an individual mold, and drawing air out;

isostatic pressing: placing each mold filled with the ingredients within a pressurized container, and molding the powder material with a hot or cold or warm isostatic pressing technique to obtain various component blanks;

demolding: demolding a number of component blanks;

trimming: trimming the number of component blanks to obtain a desired shape;

assembling: adhering the number of component blanks into a complete insulating housing blank to be manufactured; and sintering: putting the insulating housing blank into a sintering furnace and sintering the insulating housing blank into a finished product.

* * * * *